US011194295B2

(12) United States Patent
Katzer et al.

(10) Patent No.: US 11,194,295 B2
(45) **Date of Patent: *Dec. 7, 2021**

(54) SMART WATCH

(71) Applicant: Garmin Switzerland GmbH, Schaffhausen (CH)

(72) Inventors: Jochen R. Katzer, Gallmersgarten (DE); Carey J. Spesard, Kansas City, MO (US)

(73) Assignee: Garmin Switzerland GmbH

( * ) Notice: Subject to any disclaimer, the term of this patent is extended or adjusted under 35 U.S.C. 154(b) by 508 days.

This patent is subject to a terminal disclaimer.

(21) Appl. No.: 16/176,787

(22) Filed: Oct. 31, 2018

(65) Prior Publication Data

US 2019/0072908 A1 Mar. 7, 2019

Related U.S. Application Data

(63) Continuation of application No. 15/370,915, filed on Dec. 6, 2016, now Pat. No. 10,146,188, which is a (Continued)

(51) Int. Cl.
*G04G 9/00* (2006.01)
*G04B 19/04* (2006.01)
(Continued)

(52) U.S. Cl.
CPC ..... *G04G 9/0064* (2013.01); *G04B 19/04* (2013.01); *G04B 19/048* (2013.01);
(Continued)

(58) Field of Classification Search
CPC ..... G04G 9/00; G04G 9/0064; G04G 21/08; G04B 47/06; G04B 47/065; G04B 47/066;
(Continued)

(56) References Cited

U.S. PATENT DOCUMENTS 5,166,912 A 11/1992 Kanesaka ..... 368/110
5,253,225 A 10/1993 Vaucher ..... 368/15
(Continued)

OTHER PUBLICATIONS

Printout from http://www.computerworld.com/article/2643100/moto-360-review-an-elegant-smartwatch-with-exceptional-features.html published prior to May 8, 2015.
(Continued)

*Primary Examiner* — Daniel P Wicklund
(74) *Attorney, Agent, or Firm* — Samuel M. Korte; Max M. Ali

(57) ABSTRACT

A smart watch comprises a case, a display device configured to present a user interface disposed in substantially all of a face of the case, a bezel around the display device configured to be rotated to select a mode of operation of the smart watch, and an analog first watch arm and an analog second watch arm disposed over the display, the second watch arm coaxial with the first watch arm. In a first mode of operation, the user interface presents a watch dial and control the first and second watch arms indicate a time of day first and second watch arms to indicate a time of day. In a second mode of operation, the user interface presents a dial and control the first and second watch arms form a pointer, the pointer configured to indicate a reading on the dial.

20 Claims, 27 Drawing Sheets

Related U.S. Application Data continuation of application No. 14/707,926, filed on May 8, 2015, now abandoned.

(51) Int. Cl.

| | |
|---|---|
| ***G04C 17/00*** | (2006.01) |
| ***G04C 3/00*** | (2006.01) |
| ***G04B 47/06*** | (2006.01) |
| *G04G 21/08* | (2010.01) |

(52) U.S. Cl.

CPC ..... *G04B 47/065* (2013.01); *G04B 47/066* (2013.01); *G04B 47/068* (2013.01); *G04C 3/002* (2013.01); *G04C 17/00* (2013.01); *G04G 9/00* (2013.01); *G04G 21/08* (2013.01)

(58) Field of Classification Search

CPC .... G04B 47/068; G04B 19/04; G04B 19/048; G04C 3/002; G04C 17/00

See application file for complete search history.

(56) References Cited

U.S. PATENT DOCUMENTS

| | | | | |
|---|---|---|---|---|
| 5,500,835 | A | 3/1996 | Born | 368/11 |
| 5,528,559 | A | 6/1996 | Lucas | 368/10 |
| 6,477,117 | B1 | 11/2002 | Narayanaswami et al. | 358/251 |
| 6,556,222 | B1 | 4/2003 | Narayanaswami et al. | 345/786 |
| 6,754,137 | B1 | 6/2004 | Bourquin | 368/10 |
| 7,113,451 | B1 | 9/2006 | Matthey | 368/10 |
| 7,778,118 | B2 | 8/2010 | Lyons | 368/69 |
| 7,948,830 | B2 | 5/2011 | Suzuki | 368/11 |
| 8,088,043 | B2 | 1/2012 | Andren | 368/10 |
| 8,896,526 | B1 | 11/2014 | Park | 345/156 |
| 8,994,827 | B2 | 3/2015 | Mistry | 348/158 |
| 9,104,180 | B2 | 8/2015 | Springer | |
| 9,348,320 | B1 | 5/2016 | Defazio | |
| 2008/0151697 | A1 | 6/2008 | Giauque | 368/14 |
| 2011/0137519 | A1 | 6/2011 | Christe | 701/36 |
| 2013/0033970 | A1 | 2/2013 | Miyake | 368/80 |
| 2015/0253736 | A1 | 9/2015 | Watterson | 368/10 |
| 2016/0091867 | A1 | 3/2016 | Mansour | 368/294 |

OTHER PUBLICATIONS

Printout from http://www.digitaltrends.com/watch-reviews/iq-g-watch-r-smartwatch-review/ published prior to May 8, 2015.

Printout from http://www.pcmag.com/article2/0.2817.2429049.00.asp published prior to May 8, 2015.

Battery-Free Indoor Wall Thermometer and Hygrometer, published on Nov. 2, 2012, retrieved on Jan. 5, 2017 from http://www.dx.com/p/battery-free-indoor-wall-thermometer-and-hygrometer-humidity-55583, full document.

SMART WATCH

CROSS-REFERENCE TO RELATED APPLICATIONS

The present application is a continuation of, and claims priority benefit to, co-pending and commonly assigned U.S. non-provisional patent application entitled, "SMART WATCH," application Ser. No. 15/370,915, filed Dec. 6, 2016, which in turn claims the benefit of U.S. non-provisional patent application entitled, "SMART WATCH," application Ser. No. 14/707,926, filed May 8, 2015. The above-identified applications are hereby incorporated by reference into the current application in their entirety.

BACKGROUND

Watches are portable timepieces configured to be carried or worn by a user, thus allowing the user to determine the time in a convenient manner. A wristwatch is a watch configured to be worn on a wrist of the user, and is attached to the wrist by a wrist strap such as a leather strap, plastic band, or metal bracelet. A pocket watch is a watch that is configured to be carried in a pocket of a garment worn by the user. Traditionally, watches have displayed the time using an analog display comprised of a face having a watch dial, over which a rotating hour hand and a longer, rotating minute hand are disposed. Many watches also incorporate a third, rotating second hand that shows the current second of the current minute. Digital watches employ a digital display (e.g., a Light Emitting Diode (LED), a Liquid Crystal Display (LCD), etc.) in place of the analog display and rotating hands.

Smart watches are watches, typically wristwatches, which furnish functionality that is enhanced beyond timekeeping. For example, some smart watches comprise wearable electronic devices that can execute applications or apps, play back digital media, and furnish Internet connectivity. Some smart watches are further equipped with a Global Positioning System (GPS) receiver to furnish location-based functionality. Smart watches typically employ a display device for displaying information to a user. Many smart watches further utilize touchscreens to facilitate interaction by the user with information displayed by the display device.

SUMMARY

A smart watch is disclosed that comprises a display device over which analog rotating hands are disposed. In embodiments, the smart watch comprises a case having a face, in which a display device is disposed to display information to a user of the smart watch. Analog watch arms disposed over the display device are configured to independently rotate between one or more configurations to support the display of information by the display device. In one or more embodiments, a bezel is disposed in the face of the case around the display device. The bezel is configured to be rotated with respect to the display device to select a mode of operation of the smart watch, wherein the analog watch arms may be independently rotated between one or more configurations in response to the mode of operation selected.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. The use of the same reference numbers in different instances in the description and the figures may indicate similar or identical items.

Figure 1A:
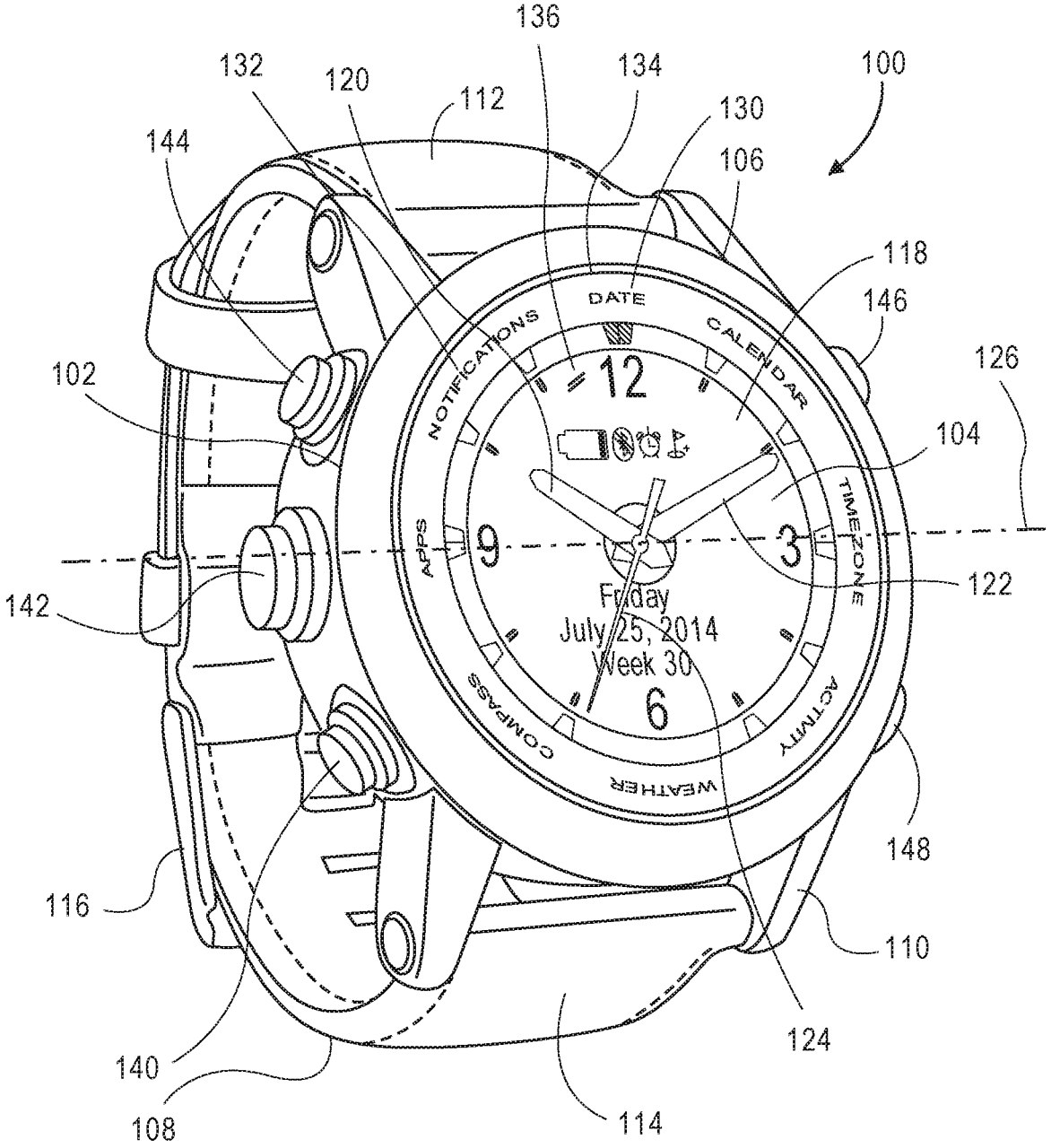
FIG. 1A is an isometric view illustrating a smart watch in accordance with an example embodiment of the present disclosure.

The drawing figures do not limit the smart watch to the specific embodiments disclosed and described herein. Further, the drawings are not necessarily to scale, emphasis instead being placed upon clearly illustrating elements of the smart watch.

DETAILED DESCRIPTION

Overview

Smart watches are becoming increasingly popular due to their increased functionality compared to conventional wristwatches. For example, smart watches can execute applications or apps, play back digital media, furnish cellular telephone and Internet connectivity (e.g., via a link with another device such as a smart phone), track parameter related to a user's fitness, and furnish location-based functionality such as mapping, turn by turn directions, and so forth. Smart watches typically employ a small digital display for displaying information to a user and input/output devices such as buttons and/or a touchscreens overlaying the display to facilitate interaction by the user with information displayed by the display device.

Many persons who wear wrist watches find the digital display employed by most smart watches unattractive. In response, smart watch designers have often attempted to emulate conventional watches by causing the watch's display device to display indicia mimicking the dial and watch arms of an analog watch. Nevertheless, many wristwatch wearers still prefer the appearance of analog wrist watches, which they find more aesthetically appealing. However, conventional watches employ movements that utilize a common gear (wheel) train to turn the watch arms. Thus, the motion of each of the watch arms is tied to the rotation of the other watch arms (e.g., the minute hand rotates one increment each time the second hand sweeps the dial, the hour hand rotates one increment each time the minute hand sweeps the watch dial, and so forth). Consequently, the use of conventional analog watch arms in combination with a display of a smart watch is impractical since the analog watch arms would obscure the display or limit the size and shape of the display.

Accordingly, a smart watch is disclosed that comprises a case having a face that includes a display device configured to display information to a user of the smart watch. One or more analog watch arms are disposed on the face over the display device. For example, in embodiments, an analog first watch arm (e.g., an "hour hand") and a second analog watch arm (e.g., "minute hand") may be disposed over the display device in the face. Additional analog watch arms may be provided. For example, an analog third watch arm (e.g., a "second hand") may be disposed over the display. Watch arms may be coaxial (i.e., rotate about the same axis), non-coaxial, or both.

In accordance with the present disclosure, one or more watch arms (e.g., the first watch arm, the second watch arm, the third watch arm, etc.) are capable of independently rotating to support the display of information by the display device. For example, the watch arms may be configured to independently rotate between one or more configurations to support the display of information by the display device thereby improving the user experience. In embodiments, a watch arm drive disposed within the case may independently rotate the watch arms between one or more configurations. A bezel may be disposed in the face of the case around the display device. The bezel is configured to be rotated with respect to the display device to select a mode of operation of the smart watch. One or more of the watch arms may be independently rotated between one or more configurations by the watch arm drive in response to the mode of operation selected.

In embodiments, when the bezel is rotated to select a mode of operation that causes the smart watch to furnish timekeeping functionality, the display device may be configured to display a watch dial, and the watch arms independently rotated to a first configuration, wherein the watch arms are configured to indicate a time of day. When the watch arms are rotated to a second configuration, the first watch arm may, for example, be rotated to a first position, while the second watch arm is rotated to a second position about the axis independently of the first watch arm, the second position being collinear with and opposite the first position with respect to the axis of rotation. The watch arms rotate to a fixed position. In this manner, the watch arms may quickly position themselves (e.g., horizontally, at the nine (9) o'clock and three (3) o'clock positions, respectively, vertically, at the twelve (12) o'clock and six (6) o'clock positions, respectively, and so forth) to support viewing of information displayed by the display device. In other examples, when the watch arms are rotated to a second configuration, the first position may be fixed with respect to the second position, so that the first watch arm and second watch arm and any additional watch arms, if provided, may rotate about the axis. For example, the display device may be configured to display a compass rose, while the watch arms form a compass needle configured to indicate a direction on the compass rose. In further examples, when watch arms are rotated to a second configuration, the first watch arm may be rotated to a first position about the axis, while the second watch arm and any additional watch arms, if provided, are rotated to a second position overlaying (or underlying) the first position. Thus, the display device may be configured to display a dial, while the watch arms form a pointer configured to indicate a reading on the dial.

In the following discussion, an example smart watch employing independently rotatable watch arms is first described. Example functionality is then described that may be implemented by the smart watch in accordance with the present disclosure.

Example Environment

Figure 1B:
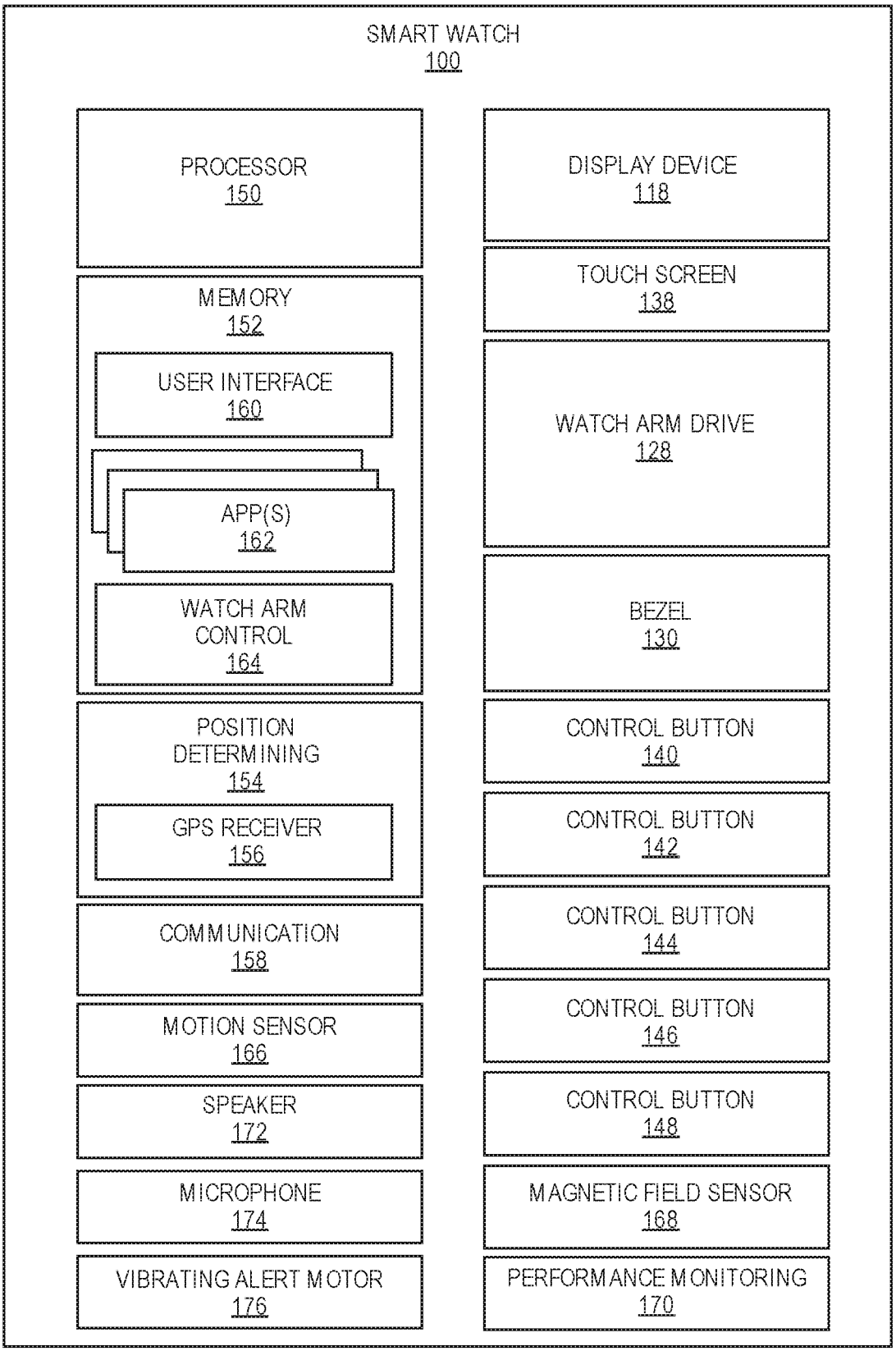
FIG. 1B is a block diagram illustrating example components of the smart watch shown in FIG. 1A.

FIGS. 1A and 1B illustrate a smart watch 100 in accordance with an example embodiment of the present disclosure. As shown, the smart watch 100 comprises a case 102 having a face 104, side surfaces 106, and a back (not shown). In the embodiment illustrated, the smart watch 100 comprises a wristwatch designed to be worn about the wrist of a user. However, in other embodiments, it is contemplated that the smart watch 100 may comprise a pocket watch, a pendant watch, and so forth. When configured as a wristwatch, as shown in FIG. 1A, the smart watch 100 further includes a wristband 108 that is attached to the case via pins (not shown) that engage lugs 110 formed in the case 102. The wristband 108 comprises straps 112, 114 having a closure 116 such as a buckle, a deployant clasp, or the like. The straps 112, 114, may be formed of a variety of materials including, but not limited to: leather, metal (e.g., stainless steel, gold, silver, etc.), canvas, or synthetic materials such as fluoroelastomer, nylon fabric, silicone, or the like. In other embodiments, the wristband 108 may comprise a metal bracelet such as link bracelet, a loop bracelet, or a mesh bracelet, which may flex to permit a user to put the smart watch on his or her wrist, or may include a closure 116 such as a folding clasp, a hidden clasp, or the like.

A display device 118 is disposed in the face 104 of the smart watch 100 to display information to the user. As shown, the display device 118 may be generally circular (round) in shape, and may occupy substantially all of the face 104 of the smart watch 100. In the embodiment shown, the display device 118 may employ an electrophoretic ink display such as an E INK display (E INK is a registered trademark of E Ink Corporation, Cambridge, Mass.) configured to display text and/or graphical information such as a graphical user interface. However, in other embodiments, the display device 118 may comprise an LCD (Liquid Crystal Diode) display, a TFT (Thin Film Transistor) LCD display, an LEP (Light Emitting Polymer) or PLED (Polymer Light Emitting Diode) display, and so forth. The display 118 may utilize ambient lighting to permit viewing of displayed information, may be backlit via a backlight such that it may be viewed in the dark or other low-light environments, may be frontlit, or may employ no light source at all.

One or more rotating analog watch arms 120, 122, 124 are disposed on the face 104 of the smart watch 100 over the display device 118. For example, in the illustrated embodiment, the smart watch 100 includes an analog first watch arm (e.g., an "hour hand") 120, an analog second watch arm (e.g., a "minute hand") 122, and an analog third watch arm (e.g., a "second hand" or "sweep hand") 124 in the face 104 over the display device 118 so that the first watch arm 120, the second watch arm 122, and the third watch arm 124 rotate about a common axis of rotation 126 (see FIG. 2). Watch arms may be coaxially mounted, non-coaxially mounted, or both. As shown, the first watch arm 120, second watch arm 122, and third watch arm 124 may be independently coupled to a watch arm drive 128 so that the watch arms 120, 122, 124 are capable of independently rotating to support the display of information by the display device 118. For example, the first watch arm 120, the second watch arm 122, and the third watch arm 124 may be configured to independently rotate between one or more configurations so that information may be displayed by the display device 118 without unnecessary obstruction by the watch arms 120, 122, 124. In embodiments, the watch arm drive 128 may independently rotate the first watch arm 120, the second watch arm 122, and the third watch arm 124 between the first configuration and the second configuration. Thus, unlike the movement of a conventional watch, in which the watch arms are driven by a wheel gear train and move in a defined relationship to one another, the watch arm drive 128 may turn each watch arm 120, 122, 124 independently of the other watch arms 120, 122, 124 between the first configuration and the second configuration.

The smart watch 100 further includes a bezel 130 disposed in the face 104 of the case 102 around the display device 118. The bezel 130 is configured to be rotated by the user about the display device 118 to select a mode of operation of the smart watch 100. For example, the bezel 130 may be provided with multiple mode selections 132, which are rotated by the user to a selection detent position 134 to select the mode of operation of the smart watch 100. As discussed herein, the watch arms (e.g., the first watch arm 120, the second watch arm 122, and the third watch arm 124) may be independently rotated between configurations depending on the mode selection 132 chosen.

A watch crystal 136 is provided over the watch arms 120, 122, 124 and the display device 118. For example, as shown in FIG. 1A, a cavity may be formed in the face 104 of the case 102 within the bezel 130 over the display device 118, in which the watch arms 120, 122, 124 are disposed and rotate. The watch crystal 136 is positioned within the bezel 130 and encloses the display device 118 and watch arms 120, 122, 124 within the cavity to protect the display device 118 and watch arms 120, 122, 124 from the environment. In embodiments, the watch crystal may be formed of a suitable material such plastic, glass, mineral glass, synthetic sapphire, and so forth.

In an embodiment, the watch crystal 136 can be provided with a touch screen 138 for entry of data and commands. In one or more implementations, the touch screen 138 can be a resistive touch screen, a capacitive touch screen, combinations thereof, and the like. Capacitive touch screens can include surface capacitance touch screens, projected capacitance touch screens, mutual capacitance touch screens, and self-capacitance touch screens. In implementations, the touch screen 138 is configured with hardware to generate a signal to send to a processor 150 and/or driver upon detection of a touch input and/or a hover input. As indicated herein, touch inputs include inputs, gestures, and movements where the input contacts the touch screen 138. Hover inputs include inputs, gestures, and movements where the input does not contact the touch screen 138, but is detected proximal to the touch screen 138.

The smart watch 100 further includes one or more control buttons (five control buttons 140, 142, 144, 146, 148 are illustrated) positioned in the side surface 106 of the case 102. The control buttons 140, 142, 144, 146, 148 are operable to control functionality of the smart watch 100. For example, one or more of the control buttons 140, 142, 144, 146, 148 may be selected (depressed) in response to information displayed by the display device 118 to provide inputs to control operation of the smart watch 100. In embodiments, where the smart watch 100 includes a touch screen 138, the control buttons 140, 142, 144, 146, 148 may be used in conjunction with the touch screen 138.

As shown in FIG. 1B, the smart watch 100 is illustrated as including a processor 150 and a memory 152. The processor 150 provides processing functionality for the smart watch 100 and can include any number of processors, micro-controllers, or other processing systems, and resident or external memory for storing data and other information accessed or generated by the smart watch 100. The processor 150 can execute one or more software programs (e.g., an operating system (OS), a user interface (UI), applications, etc.) that implement the techniques and modules described herein. The processor 150 is not limited by the materials from which it is formed or the processing mechanisms employed therein and, as such, can be implemented via semiconductor(s) and/or transistors (e.g., electronic integrated circuits (ICs)), and so forth.

The memory 152 is an example of a tangible, non-transient device-readable storage media that provides storage functionality to store various data associated with the operation of the smart watch 100, such as the software program and code segments mentioned above, or other data to instruct the processor 150 and other elements of the smart watch 100 to perform the techniques described herein. Although a single memory 152 is shown, a wide variety of types and combinations of memory can be employed. The memory 152 can be integral with the processor 150, stand-alone memory, or a combination of both. The memory 152 can include, for example, removable and non-removable memory elements such as RAM, ROM, Flash (e.g., SD Card, mini-SD card, micro-SD Card), magnetic, optical, USB memory devices, and so forth. In embodiments of the smart watch 100, the memory 152 can include removable ICC (Integrated Circuit Card) memory such as provided by SIM (Subscriber Identity Module) cards, USIM (Universal Subscriber Identity Module) cards, UICC (Universal Integrated Circuit Cards), and so forth.

The smart watch 100 is further illustrated as including functionality to determine and/or display position. More particularly, smart watch 100 can include or be coupled to a position-determining system 154 that can manage and process signal data received from Global Positioning System (GPS) satellites via a GPS receiver 156. The position-determining system 154 is representative of functionality operable to determine and/or display a geographic position through processing of the received signal data. The signal data can include various data suitable for use in position determination, such as timing signals, ranging signals, ephemerides, almanacs, and so forth.

The position-determining system 154 can also be configured to provide a variety of other position-determining functionality. Position-determining functionality, for purposes of discussion herein, can relate to a variety of different navigation techniques and other techniques that can be supported by "knowing" one or more positions. For instance, position-determining functionality can be employed to provide position/location information, timing information, speed information, and a variety of other navigation-related data. Accordingly, the position-determining system 154 can be configured in a variety of ways to perform a wide variety of functions. For example, the position-determining system 154 can be configured for outdoor navigation, vehicle navigation, aerial navigation (e.g., for airplanes, helicopters), marine navigation, personal use (e.g., as a part of fitness-related equipment), golf, and so forth. Accordingly, the position-determining system 154 can include a variety of devices to determine position using one or more of the techniques previously described.

The position-determining system 154, for instance, can use signal data received via the GPS receiver 156 in combination with map data that is stored in the memory 152 or received from paired device or remote source to generate navigation instructions (e.g., turn-by-turn instructions to an input destination or POI), show a current position on a map, and so on. The position-determining system 154 can include one or more antennas to receive signal data as well as to perform other communications, such as communication with a paired device or communication via one or more networks described in more detail below. The position-determining system 154 can also provide other position-determining functionality, such as to determine an average speed, calculate an arrival time, determine a distance and/or direction to a target location (e.g., a pin in a hole of golf), and so on.

Although a GPS system is described and illustrated in relation to FIG. 1B, it should be apparent that a wide variety of other positioning systems can also be employed, such as other global navigation satellite systems (GNSS), terrestrial based systems (e.g., wireless phone-based systems that broadcast position data from cellular towers), wireless networks that transmit positioning signals, and so on. For example, positioning-determining functionality can be implemented through the use of a server in a server-based architecture, from a ground-based infrastructure, through one or more sensors, use of "dead reckoning" techniques, and so on.

The smart watch 100 can also include a communication system 158 configured to furnish communication functionality to permit the smart watch 100 to send/receive data with one or more paired devices such as a paired smart phone, or the like, and/or over one or more wireless networks. The communication system 158 can be representative of a variety of communication components and functionality including, but not limited to: one or more antennas; a browser; a transmitter and/or receiver; a wireless radio; software interfaces and drivers; networking interfaces; data processing components; and so forth.

The communication system 158 may be capable of utilizing a variety of different types of networks and connections, including, but not limited to: the Internet; an intranet; a satellite network; a cellular network; a mobile data network; a wireless network, and so forth. Examples of wireless networks include, but are not limited to: Bluetooth wireless networks complying with Bluetooth standards promulgated by the Bluetooth Special Interest Group; personal wireless networks including, but not limited to, ANT or ANT+ wireless personal area networks (ANT Wireless, a division of Dynastream Innovations Inc.); networks configured for communications according to: one or more standard of the Institute of Electrical and Electronics Engineers (IEEE), such as 802.11 or 802.16 (Wi-Max) standards; Wi-Fi standards promulgated by the Wi-Fi Alliance; and so on. Wired communications are also contemplated such as through universal serial bus (USB), Ethernet, serial connections, and so forth. The smart watch 100, through functionality represented by the communication system 158, can be configured to communicate via one or more networks with a cellular provider and/or an Internet provider to receive mobile phone service and various content, examples of which include, but are not limited to: map data which can include speed limit data; web pages; services; music; photographs; video; email service; instant messaging; applications 162; device drivers; instruction updates; and so forth.

The smart watch 100 is illustrated as employing a user interface 160, which is storable in the memory 152 and executable by the processor 150. The user interface 160 is representative of functionality to control the display of information and data to the user of the smart watch 100 via the display device 118. The user interface 160 can provide functionality to allow the user to interact with one or more applications 162 of the smart watch 100 by providing inputs via the control buttons 140, 142, 144, 146, 148 and/or the touch screen 138. The user interface 160 can cause an application programming interface (API) to be generated to expose functionality to an application 162 to configure the application for display by the display device 118. In embodiments, the API can further expose functionality to configure the application 162 to allow the user to interact with an application by providing inputs via the bezel 130, control buttons 140, 142, 144, 146, 148, and/or the touchscreen 138. Applications 162, which may include applications, mobile applications (mobile apps), and so forth, comprise software, which is storable in memory 152 and executable by the processor 150, to perform a specific operation or group of operations to furnish functionality to the smart watch 100. Applications 162 can include browser applications, cellular telephone applications, instant messaging applications, email applications, photograph sharing applications, calendar applications, address book applications, media player applications, fitness/health monitoring applications, sport related applications, navigation related applications, combinations thereof, and so forth. Example applications 162 are described in the discussion of FIGS. 13A through 19C.

In embodiments, the user interface 160 may further include a browser. The browser enables the smart watch 100 to display and interact with content such as a webpage within the World Wide Web, a webpage provided by a web server in a private network, and so forth. In some embodiments, the browser may be implemented as an application 162 that may be stored in memory and executed by the processor 150.

The smart watch 100 is illustrated as including a watch arm control module 164, which is storable in memory 152 and executable by the processor 150. The watch arm control module 164 represents functionality to furnish control of the watch arm drive 128 to independently turn the watch arms 120, 122, 124 as described herein below with respect to FIGS. 2 and 3A through 3E. The functionality represented by the watch arm control module 164 may thus be employed in concert with functionality provided by the user interface 160 and applications 162 to support the display of information to the user of the smart watch 100 via the display device 118. The watch arm control module 164 may receive inputs from the bezel 130, control buttons 140, 142, 144, 146, 148, and/or the touch screen 138, for example, via the user interface 160. The watch arm control module 164 may then cause the watch arm drive 128 to turn the watch arms 120, 122, 124 in a manner indicated by the inputs made.

The smart watch 100 is further illustrated as including a motion sensor 166 that detects motion (movement) of the smart watch 100. In embodiments, the motion sensor 166 can comprise an accelerometer to detect proper acceleration of the smart watch 100 from which the motion of the smart watch 100 may be determined. The smart watch 100 may further include a magnetic field sensor 168 that may enable the accurate determination of a direction by sensing the electromagnetic field of the Earth.

In embodiments, the smart watch 100 can further be equipped with a performance monitoring component 170. The performance monitoring component 170 may be positioned within the case 102 or may be coupled to the smart watch via the communication system 158. The performance monitoring component 170 may receive information, including, but not limited to geographic location information, from the position determining system 154, to perform a function, such as monitoring performance and/or calculating performance values and/or information related to the user's movement (e.g., exercise). The monitoring of the performance and/or the calculating performance values may be based at least in part on the geographic location information. The performance values may include, for example, a user's heart rate, speed, a total distance traveled, total distance goals, speed goals, pace, cadence, and calories burned. These values and/or information may be employed by the smart watch 100, for example, when the smart watch 100 is in the activity mode of operation, and/or by one or more applications 162 when the smart watch 100 is in the app mode of operation.

The smart watch 100 may further include a speaker 172 configured to furnish audible alerts (such as beeps, ringtones). In embodiments, the speaker 172 may further be capable of furnishing playback of media, voice communications, and so forth. A microphone 174 may be provided to enable audio input such as input of voice communications, speech to text communications, recording of voice memos, entry of voice commands, recording of media, and so forth. The smart watch 100 may also include and/or a vibrating alert motor 176 configured to furnish a vibrating alert.

Figure 2:
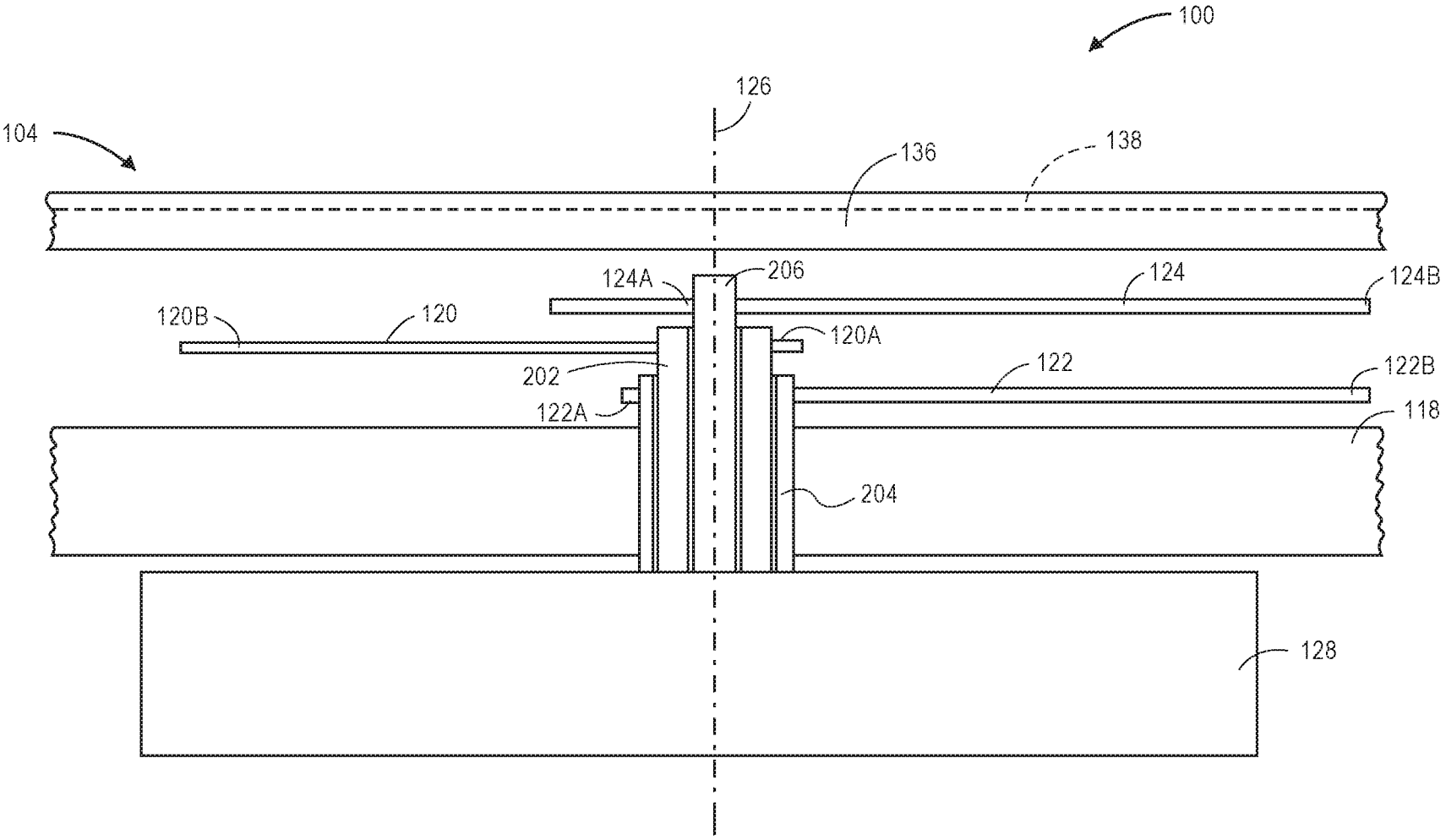
FIG. 2 is a diagrammatic, cross-sectional, side elevation view further illustrating operation of an example watch arm drive to drive the analog watch arms of the smart watch shown in FIGS. 1A and 1B.

FIG. 2 further illustrates operation of the analog watch arms 120, 122, 124 by the watch arm drive 128 in an example embodiment of the smart watch 100. As noted, the watch arms 120, 122, 124 are disposed on the face 104 of the smart watch 100 over the display device 118. In the embodiment shown, the smart watch 100 includes an analog first watch arm (an hour hand) 120, an analog second watch arm (a minute hand) 122, and an analog third watch arm (a second hand or sweep hand) 124 coaxially mounted in the face 104 over the display device 118 so that the first watch arm 120, the second watch arm 122, and the third watch arm 124 rotate about a common axis of rotation 126. The first watch arm 120, second watch arm 122, and third watch arm 124 each include a shaft end 120A, 122A, 124A, respectively, and a distal pointer end 120B, 122B, 124B, respectively. The shaft ends 120A, 122A, 124A, may be independently coupled to the watch arm drive 128 via respective, coaxial drive shafts 202, 204, 206. As shown, the shaft end 122A of the second (minute) watch arm 122 is coupled to, and rotated by, an outermost shaft 204; while the shaft end 120A of the first watch (hour) hand 120 is coupled to, and rotated by, an intermediate shaft 202, which extends above the outermost shaft 204; and the shaft end 124A of the third watch (second or sweep) hand 124 is coupled to, and rotated by, an innermost shaft 206, which extends above the intermediate shaft 202 with respect to the surface of the display device 118.

The watch arm drive 128 may drive each of the shafts 202, 204, 206 independently of one another in either the clockwise or counterclockwise directions with respect to the common axis of rotation 126. In this manner, the watch arm drive 128 can rotate any of the watch arms 120, 122, 124, either clockwise or counterclockwise, in response to commands from the watch arm control module 164 (FIG. 1B) to support the display of information by the display device 118. For example, the watch arm drive 128 can independently turn the respective coaxial drive shafts 202, 204, 206 to rotate the first watch arm 120, the second watch arm 122, and the third watch arm 124 between one or more configurations to support the display of information by the display device 118. In embodiments, the watch arm drive 128 may include one or more motors and associated gear trains to independently drive (turn) each of the shafts 202, 204, 206 to rotate each of the respective watch arms 120, 122, 124. Thus, unlike the movement of a conventional watch, in which the watch arms are driven in a clockwise direction by a single wheel (gear) train and move in a defined relationship to one another, the watch arm drive 128 may turn each watch arm 120, 122, 124 independently of the other watch arms 120, 122, 124, either clockwise or counterclockwise.

FIGS. 3A through 3E depict the face 104 of the smart watch 100, wherein the analog watch arms 120, 122, 124 are rotated between example first and second configurations 302, 304, 306, 308, 310. It will be appreciated that the illustrated configurations 302, 304, 306, 308, 310 shown in FIGS. 3A through 3E, and discussed herein, as well as any other contemplated configurations, may be considered a first configuration or a second configuration as those terms are used herein. Consequently, any of the configurations 302, 304, 306, 308, 310 can be a "first configuration" from which the watch arms 120, 122, 124 may be rotated to any other of the configurations 302, 304, 306, 308, 310, which may be considered a "second configuration." Further, as discussed below, in any or all of the configurations shown 302, 304, 306, 308, 310, any or all of the watch arms 120, 122, 124 may be rotatable (either clockwise or counterclockwise); may be fixed (stationary) in relation to the display device 118 and face 104; or may be fixed in relation to one another but rotatable (either clockwise or counterclockwise) in relation to the display device 118 and face 104. Moreover, it is contemplated that the watch arms 120, 122, 124 may be rotated to any combination of positions (fixed and/or rotatable) as required to support the display of information by the display device 118.

Figure 3A:
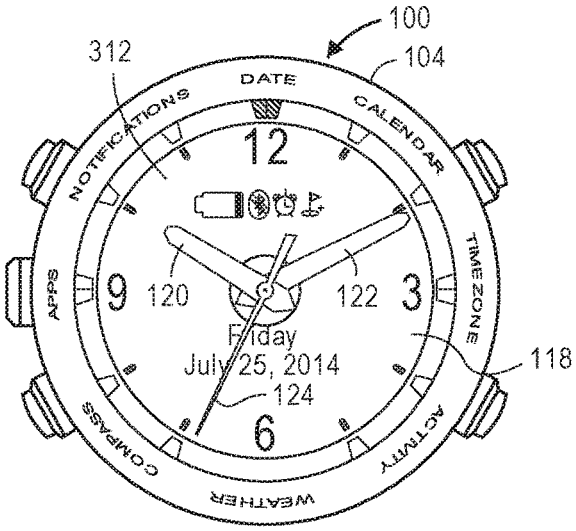
FIGS. 3A, 3B, 3C, 3D, and 3E are top plan views of the face of the smart watch shown in FIGS. 1A and 1B, further illustrating rotation of the analog watch arms between different configurations.

In FIG. 3A, the watch arms 120, 122, 124 are shown in an example configuration (hereinafter the "timekeeping configuration" 302), wherein the display device 118 is configured to display a watch dial 312, and the watch arms 120, 122, 124 are rotated in relation to one another to indicate a time of day in the manner of a conventional watch or clock. Thus, in the illustrated timekeeping configuration 302, the third watch arm (second or sweep hand) 124 makes one complete rotation about the watch dial 312 every sixty (60) seconds; the second watch arm (minute hand) 122 moves one increment of the watch dial 312 each time the third watch arm (second or sweep hand) 124 makes one rotation of the watch dial 312 and makes one complete rotation about the watch dial 312 every sixty (60) minutes; and the first watch arm (hour hand) 120 moves one increment of the watch dial 312 each time the second watch arm (minute hand) 122 makes one rotation of the watch dial 312 and makes one complete rotation about the watch dial 312 every twelve (12) hours when the watch dial is configured as a twelve (12) hour dial, or, once every twenty-four (24) hours if the watch dial 312 is configured as a twenty-four (24) hour dial (e.g., complying with international standard ISO 8601).

Figure 3B:
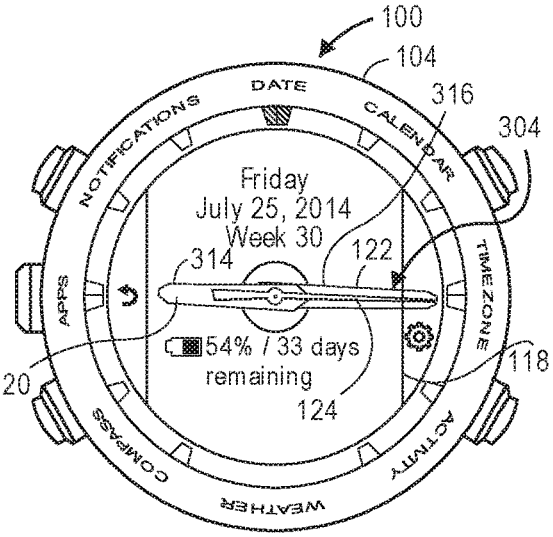
Figure 3C:
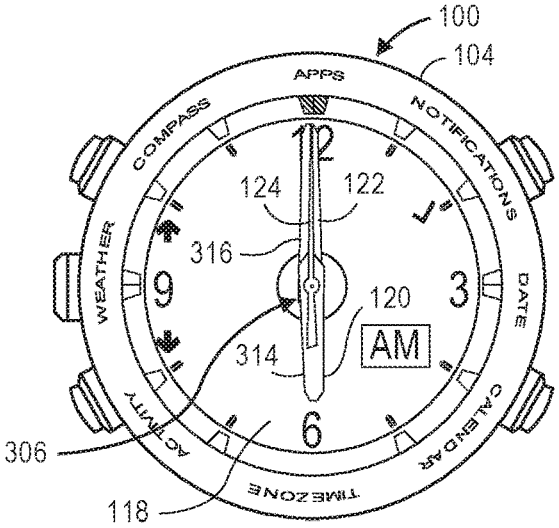

In FIGS. 3B and 3C, the watch arms 120, 122, 124 are shown rotated to additional example configurations 304, 306. In these configurations, first, second, and third watch arms 120, 122, 124 are rotated to fixed (stationary) positions 314, 316 in relation to the display device 118 and face 104 to support the display of information by the display device 118. In the embodiment illustrated, the first watch arm 120 is rotated to a first fixed position 314, while the second watch arm 122 and the third watch arm 124 are each rotated to a second fixed position 316 about the common axis of rotation 126 independently of the first watch arm 120 and one another. As shown, the second fixed position 316 is collinear with and opposite the first fixed position 314 with respect to the axis of rotation 126. In FIG. 3B, the watch arms 120, 122, 124 are shown oriented horizontally (hereinafter the "horizontal fixed configuration" 304), with the pointer end 120B of the first watch arm 120 at the nine (9) o'clock position and the pointer ends 122B, 124B of the second and third watch arms 122, 124, respectively, at the three (3) o'clock position of the watch dial 312. However, depending on the positions of the watch arms 120, 122, 124 prior to rotation to the horizontal fixed configuration 304, the pointer end 120B of the first watch arm 120 can also be rotated to the three (3) o'clock position while the pointer ends 122B, 124B of either or both of the second and third watch arms 122, 124 can be rotated to the nine (9) o'clock position of the watch dial 312. Similarly, in FIG. 3C, the watch arms 120, 122, 124 are shown oriented vertically, with the pointer end 120B of the first watch arm 120 at the six (6) o'clock position and the pointer ends 122B, 124B of the second and third watch arms 122, 124, respectively, at the twelve (12) o'clock position of the watch dial 312 (hereinafter the "vertical fixed configuration" 306). Again, depending on the positions of the watch arms 120, 122, 124 prior to rotation to the second configuration 304, the pointer end 120B of the first watch arm 120 can also be rotated to the twelve (12) o'clock position while the pointer ends 122B, 124B of the second and third watch arms 122, 124, respectively, can be rotated to the six (6) o'clock position of the watch dial 312. In this manner, the watch arms 120, 122, 124 may be quickly positioned (e.g., horizontally, at the nine (9) o'clock and three (3) o'clock positions, respectively, vertically, at the twelve (12) o'clock and six (6) o'clock positions, respectively) to support viewing of information displayed by the display device 118. It is contemplated that, in another configuration, the watch arms 120, 122, 124 may be rotated to any combination of fixed positions with respect to the display device 118 as required to support the display of information by the display device 118 (e.g., the first watch arm 120 to the seven (7) o'clock and second and third watch arms 122, 124 to the five (5) o'clock positions; the first watch arm 120 to the ten (10) o'clock and the second and third watch arms 122, 124 to the one (1) o'clock positions; all watch arms 120, 122, 124 to the six (6) o'clock position; all watch arms 120, 122, 124 to the twelve (12) o'clock position, and so forth).

Figure 3D:
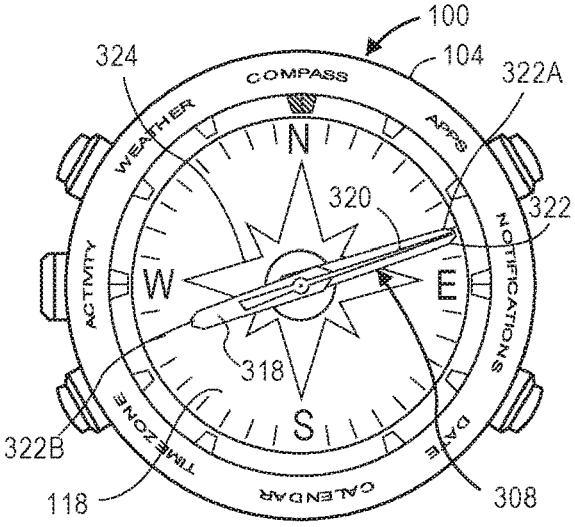
Figure 3E:
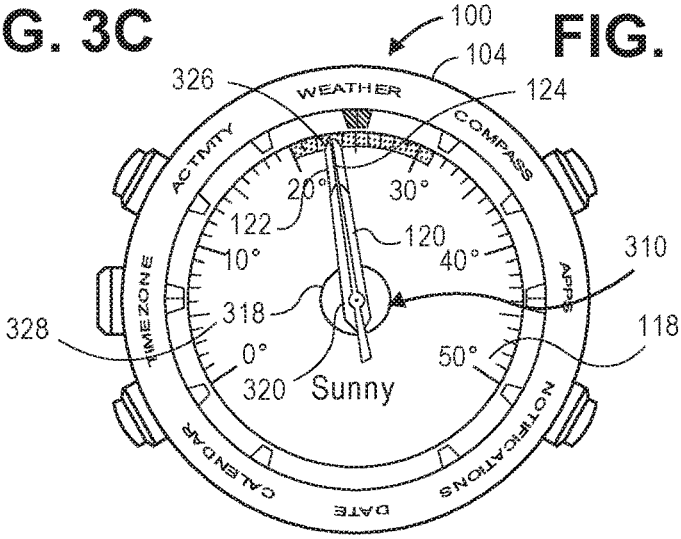

In FIGS. 3D and 3E, the watch arms 120, 122, 124 are shown in example configurations 308, 310, wherein the positions of the watch arms 120, 120, 124 are fixed with respect to one another, but can rotate with respect to the display device 118. In FIG. 3D, the first watch arm 120 is rotated to a first position 318, while the second watch arm 122 and the third watch arm 124 are each rotated to a second position 320 about the axis of rotation 126 independently of the first watch arm 120 and one another. As shown, the second position 320 is collinear with and opposite the first position 314 with respect to the common axis of rotation 126. The second position 320 is further fixed with respect to the first position 318 so that the first, second, and third watch arms 120, 122, 124 form a needle 322 having first and second ends 322A, 322B that is pivoted to rotate about the axis of rotation 126. In this configuration (hereinafter the "needle configuration" 308), for example, the display device 118 may be configured to display a compass rose 324, while the needle 322 functions as a compass needle configured to indicate a direction on the compass rose 324 (see the discussion of FIG. 10). Similarly, in FIG. 3E, the first, second, and third watch arms 120, 122, 124 are shown rotated about the common axis of rotation 126 so that the second position 320 overlays (or underlays) the first position 318 (e.g., to a common position) to form a pointer 326. In this configuration (hereinafter the "pointer configuration" 310), the display device 118 may be configured to display a dial 328, wherein the pointer 326 is configured to indicate a reading on the dial 328.

Figure 4:
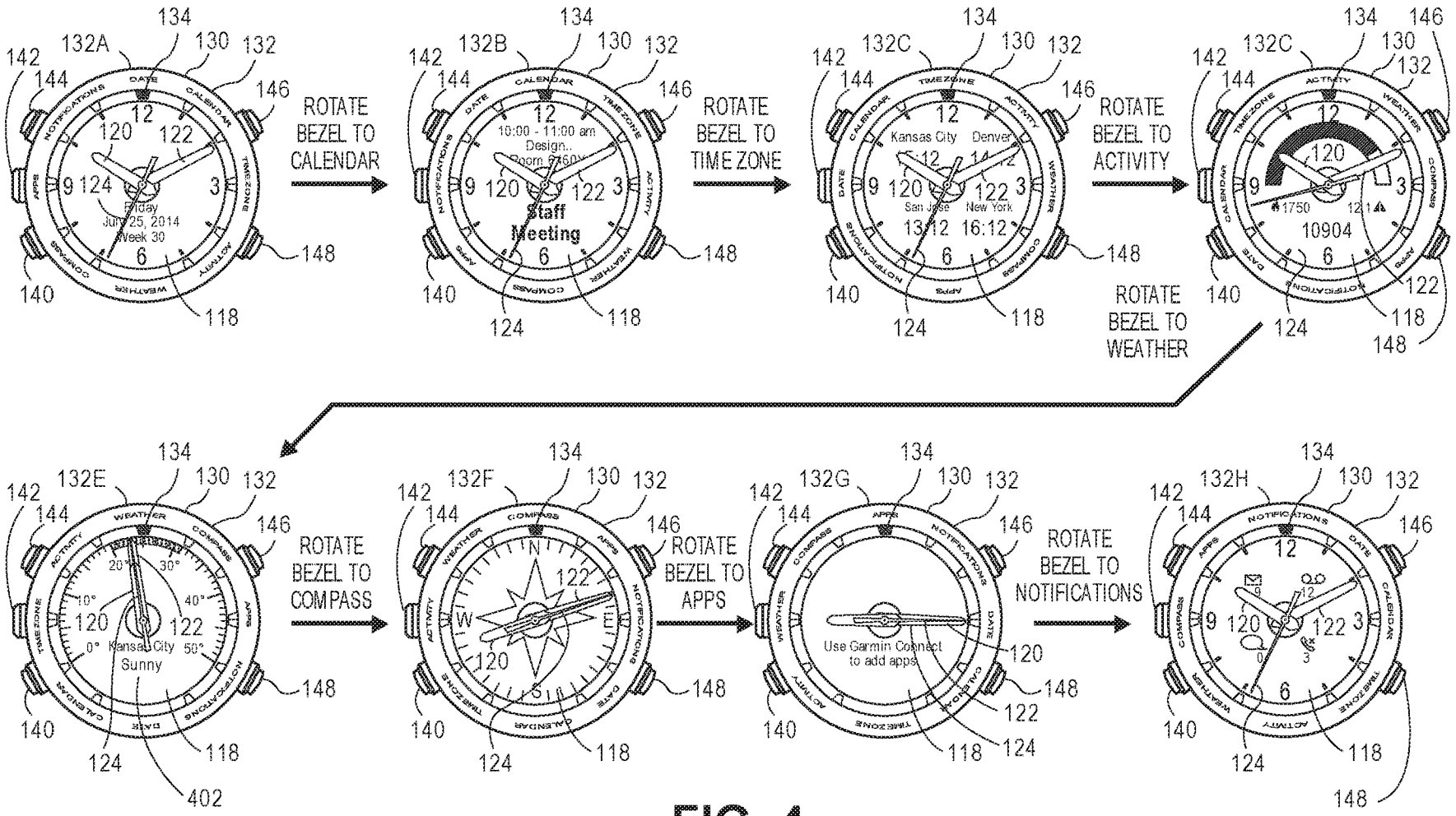
FIG. 4 is a diagrammatic illustration that includes a series of top plan views of the smart watch shown in FIGS. 1A and 1B, further illustrating a rotating bezel employed by the smart watch to facilitate user selection of a mode of operation of the smart watch to access functionality provided by the smart watch.

FIG. 4 further illustrates operation of the bezel 130. As shown, the bezel 130 is configured to be rotated by the user about the display device 118 to select a mode of operation of the smart watch 100. The bezel 130 may be provided with multiple mode selections 132, which are rotated by the user to a selection detent position 134 to select the mode of operation of the smart watch 100. In the embodiment illustrated, the selection detent position 134 is located above the display device 118 as the display device 118 is viewed by the user (at the twelve (12) o'clock position) when a watch dial is displayed by the display device 118. The bezel 130 is provided with eight (8) mode selections: "DATE" 132A, "CALENDAR" 132B, "TIME ZONE" 132C, "ACTIVITY" 132D, "WEATHER" 132E, "COMPASS" 132F, "APPS" 132G, and "NOTIFICATIONS" 132H, which may be rotated to the selection detent position 134 by the user to select the mode of operation of the smart watch 100. Thus, as shown in FIG. 4, the bezel 130 may be sequentially rotated clockwise from the mode selection "DATE" 132A to the mode selection "CALENDAR" 132B to select a calendar mode of operation of the smart watch 100; from the mode selection "CALENDAR" 132B to the mode selection "TIME ZONE" 132C to select a time zone mode of operation of the smart watch 100; from the mode selection "TIME ZONE" 132C to the mode selection "ACTIVITY" 132D to select an activity mode of operation of the smart watch 100; from the mode selection "ACTIVITY" 132D to the mode selection "WEATHER" 132E to select a weather mode of operation of the smart watch 100; from the mode selection "WEATHER" 132E to the mode selection "COMPASS" 132F to select a compass mode of operation of the smart watch 100; from the mode selection "COMPASS" 132F to the mode selection "APPS" 132G to select an apps mode of operation of the smart watch 100; from the mode selection "APPS" 132G to the mode selection "NOTIFICATIONS" 132H to select a notification mode of operation of the smart watch 100; and from the mode selection "NOTIFICATIONS" 132H to the mode selection "DATE" 132A to select the date mode of operation of the smart watch 100. The bezel 130 may also be sequentially rotated counterclockwise from the mode selection "NOTIFICATIONS" 132H to the mode selection "APPS" 132G to select the apps mode of operation of the smart watch 100; from the mode selection "APPS" 132G to the mode selection "COMPASS" 132F to select the compass mode of operation of the smart watch 100; from the mode selection "COMPASS" 132F to the mode selection "WEATHER" 132E to select the weather mode of operation of the smart watch 100, from the mode selection "WEATHER" 132E to the mode selection "ACTIVITY" 132D to select the activity mode of operation of the smart watch 100; from the mode selection "ACTIVITY" 132D to the mode selection "TIME ZONE" 132C to select the time zone mode of operation of the smart watch 100; from the mode selection "TIME ZONE" 132C to the mode selection "CALENDAR" 132B to select the calendar mode of operation of the smart watch 100; from the mode selection "CALENDAR" 132B to the mode selection "DATE" 132A to select the date mode of operation of the smart watch 100; and from the mode selection "DATE" 132A to the mode selection "NOTIFICATIONS" 132H to select the notifications mode of operation of the smart watch 100.

The watch arms (e.g., the first watch arm 120, the second watch arm 122, and the third watch arm 124) may be independently rotated between one or more configurations, such as the configurations shown in FIGS. 3A through 3E, depending on the mode selection 132 chosen, and/or inputs made via the control buttons 140, 142, 144, 146, 148 (or touchscreen 138). For example, as shown in FIG. 4, rotating the bezel 130 to the mode selection "WEATHER" 132E to select the weather mode of operation of the smart watch 100 may cause the display device 118 to display a thermometer (temperature) gauge 402, and the first, second, and third watch arms 120, 122, 124 to be rotated about the common axis of rotation 126 to the pointer configuration 310 thereby forming a pointer 326 configured to indicate a temperature on the gauge 402. Similarly, rotating the bezel 130 to the mode selection "COMPASS" 132F to select the compass mode of operation of the smart watch 100 may cause the display device 118 to display a compass rose 324, and the first, second, and third watch arms 120, 122, 124 to be rotated to the needle configuration 308, thereby forming a needle 322 configured to indicate a direction on the compass rose 324. Additionally, rotating the bezel 130 to the mode selection "APPS" 132G to select the apps mode of operation of the smart watch 100 may cause the display device 118 to display information provided by an application 162 executed by the smart watch 100, and the first, second, and third watch arms 120, 122, 124 to be rotated to the horizontal fixed configuration 304 to permit viewing of the information displayed.

In embodiments, the smart watch 100 may incorporate a combination of one or more magnets and hall-effect sensors to determine a current position of the bezel 130. For instance, one or more magnets may be positioned in known positions of the bezel 130 and one or more hall-effect sensors may be positioned in known positions of the case 102 such that the magnetic field sensed by the one or more magnetic field sensors 168 may be utilized to accurately determine a current position of the bezel 130 as the bezel 130 is rotated.

It will be appreciated that the smart watch 100 may be provided with a bezel 130 having more or fewer mode selections 132, or different mode selections 132 than the illustrated embodiment without departing from the scope and intent of the present disclosure. Moreover, the selection detent position 134 may be located elsewhere in the face 104 of the smart watch 100, such as, for example, below, to the right, or to the left of the display device 118 as the display device is viewed by the user (at the six (6) o'clock position, the three (3) o'clock position, or the nine (9) o'clock position, respectively, when a watch dial 312 is displayed by the display device 118).

Example Functionality

FIGS. 5 through 21 illustrate functionality provided by the smart watch 100 when various mode selections 132 are made by the user in accordance with example embodiments of the present disclosure. It should be understood that the functions and operations specifically shown and described herein are examples of possible functionality that may be furnished by the smart watch 100. Thus, the description of specific modes of operations and associated functionality herein should not be construed as limiting the functionality that may be provided by embodiments of the smart watch 100.

Figure 5:
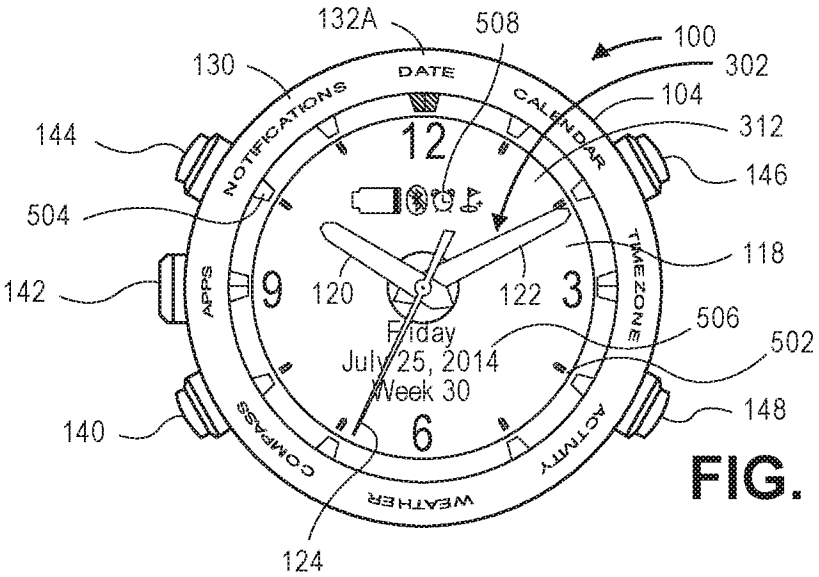
FIG. 5 is a diagrammatic top plan view of the smart watch shown in FIGS. 1A and 1B, further illustrating the smart watch configured for timekeeping, wherein the display device is configured to display a watch dial and the watch arms are configured to indicate a time of day.

FIG. 5 illustrates the smart watch 100 configured for timekeeping. As shown, the bezel 130 is rotated to the mode selection "DATE" 132A so that the date mode of operation of the smart watch 100 is selected. In this mode of operation, the display device 118 is configured to display a watch dial 312. In the embodiment shown, the displayed watch dial 312 includes the numbers "12" located at the twelve (12) o'clock position, "3" located at the three (3) o'clock position, "6" located at the six (6) o'clock position, and "9" located at the nine (9) o'clock position of the watch dial 312, with tick marks 502 positioned at the one (1) o'clock, two (2) o'clock, four (4) o'clock, five (5) o'clock, seven (7) o'clock, eight (8) o'clock, ten (10) o'clock, and eleven (11) o'clock positions. In the embodiment illustrated, permanent hour marks 504 are also be provided in the watch face 104 between the bezel 130 and the display device 118, so that the time of day may be discerned by a user when the display device 118 is not configured to display a watch dial 312. Additionally, the display device 118 is shown configured to display the current date 506 and indicia 508 indicating the status of the watch (e.g., battery life left, Bluetooth on/off, alarm set, applications being executed, etc.). It will be appreciated that, the display device 118 may be configured to display a variety of different watch dials 312. Moreover, it is contemplated that the watch dial 312 displayed may be selected by the user from a number of dial choices, which may be stored in the memory 152 of the smart watch 100, and/or downloaded to the memory 152 from an external service or another device via the communication system 158 (e.g., downloaded as a plugin via the Internet). Thus, the watch dial 312 may be furnished with ornate features/indicia such as Roman numerals, stylized numerals and/or tic marks 502, stylized backgrounds, photographic backgrounds, background artwork, logos, combinations thereof, and so forth. Additionally, the watch dial 312 may be configured as a twenty-four (24) hour dial (e.g., complying with international standard ISO 8601).

As further shown in FIG. 5, the watch arms 120, 122, 124 are rotated to the timekeeping configuration 302. As described above, in this timekeeping configuration 302, the first, second, and third watch arms 120, 122, 124 rotate in relation to one another and the display device 118 to indicate a time of day in the manner of a conventional watch. Thus, the third watch arm (second or sweep hand) 124 makes one complete rotation about the watch dial 312 every sixty (60) seconds; the second watch arm (minute hand) 122 moves one increment of the watch dial 312 each time the third watch arm (second or sweep hand) 124 makes one rotation of the watch dial 312 and makes one complete rotation about the watch dial 312 every sixty (60) minutes; and the first watch arm (hour hand) 120 moves one increment of the watch dial 312 each time the second watch arm (minute hand) 122 makes one rotation of the watch dial 312 and makes one complete rotation about the watch dial 312 every twelve (12) hours when the watch dial is configured as a twelve (12) hour dial, or, once every twenty-four (24) hours if the watch dial 312 is configured as a twenty-four (24) hour dial.

Figure 6:
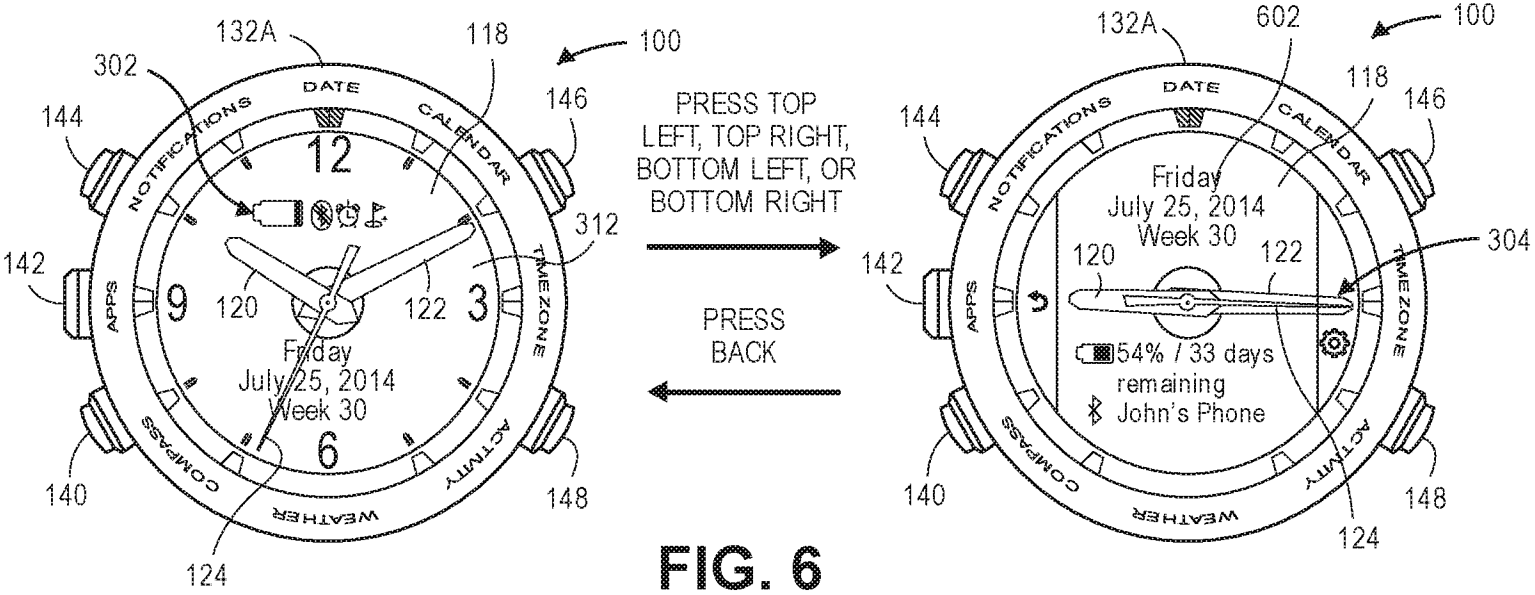
FIG. 6 is a diagrammatic illustration that includes a series of top plan views of the smart watch shown in FIGS. 1A and 1B, further illustrating the smart watch when a date mode of operation is selected so that the display device is configured to display the date.

FIG. 6 further illustrates display of information by the display device 118 of the smart watch 100 when a date mode of operation is selected. In FIG. 6, the bezel 130 is rotated to the mode selection "DATE" 132A so that the date mode of operation of the smart watch 100 is selected. As shown, the display device 118 is initially configured to display the watch dial 312 with the watch arms 120, 122, 124 rotated to the timekeeping configuration 302, as shown in FIG. 5. The user may depress a control button (e.g., the top left control button 144, the top right control button 146, the bottom left control button 140, or the bottom right control button 148) to cause the watch arms 120, 122, 124 to be rotated from the timekeeping configuration 302 (a first configuration) where the watch arms 120, 122, 124 rotate in relation to one another to indicate a time of day in the manner of a conventional watch, to the horizontal fixed configuration (a second configuration) to support the display of date and status information 602 by the display device 118. The user may again depress a control button (e.g., middle left control button 142 (Back)) to cause the watch arms 120, 122, 124 to be rotated from the horizontal fixed configuration 304 back to the timekeeping configuration 302.

Figure 7A:
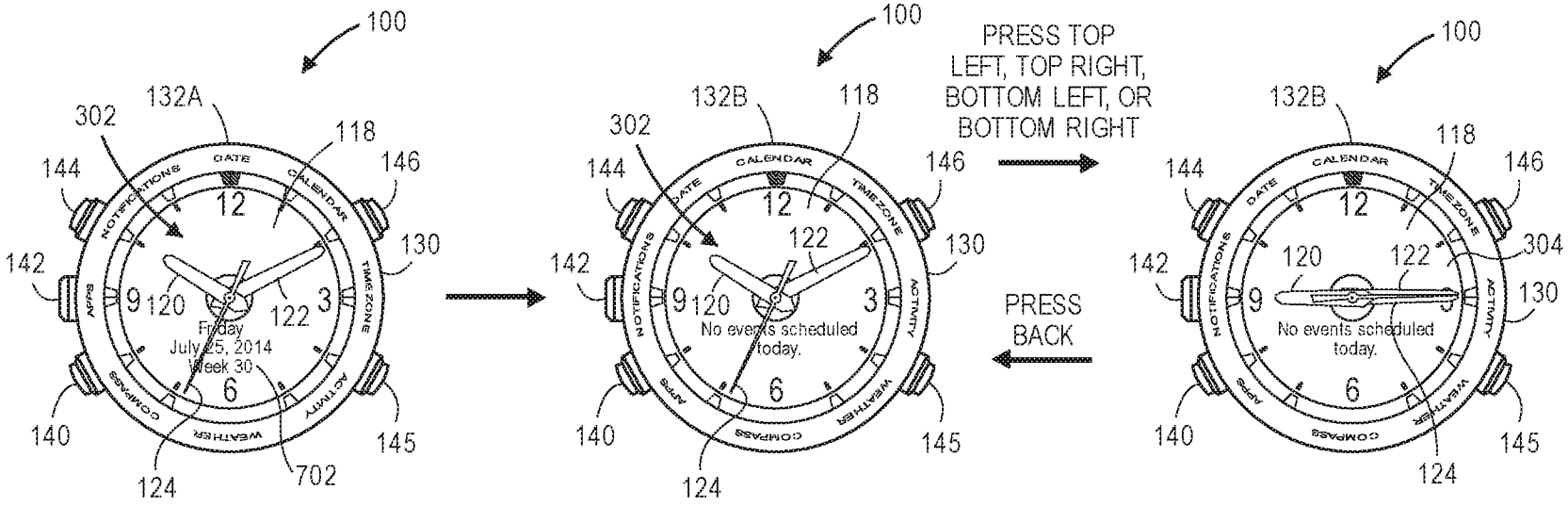
FIGS. 7A and 7B are diagrammatic illustrations that include a series of top plan views of the smart watch shown in FIGS. 1A and 1B, further illustrating the smart watch when a calendar mode of operation is selected so that the display device is configured to display calendar information.
Figure 7B:
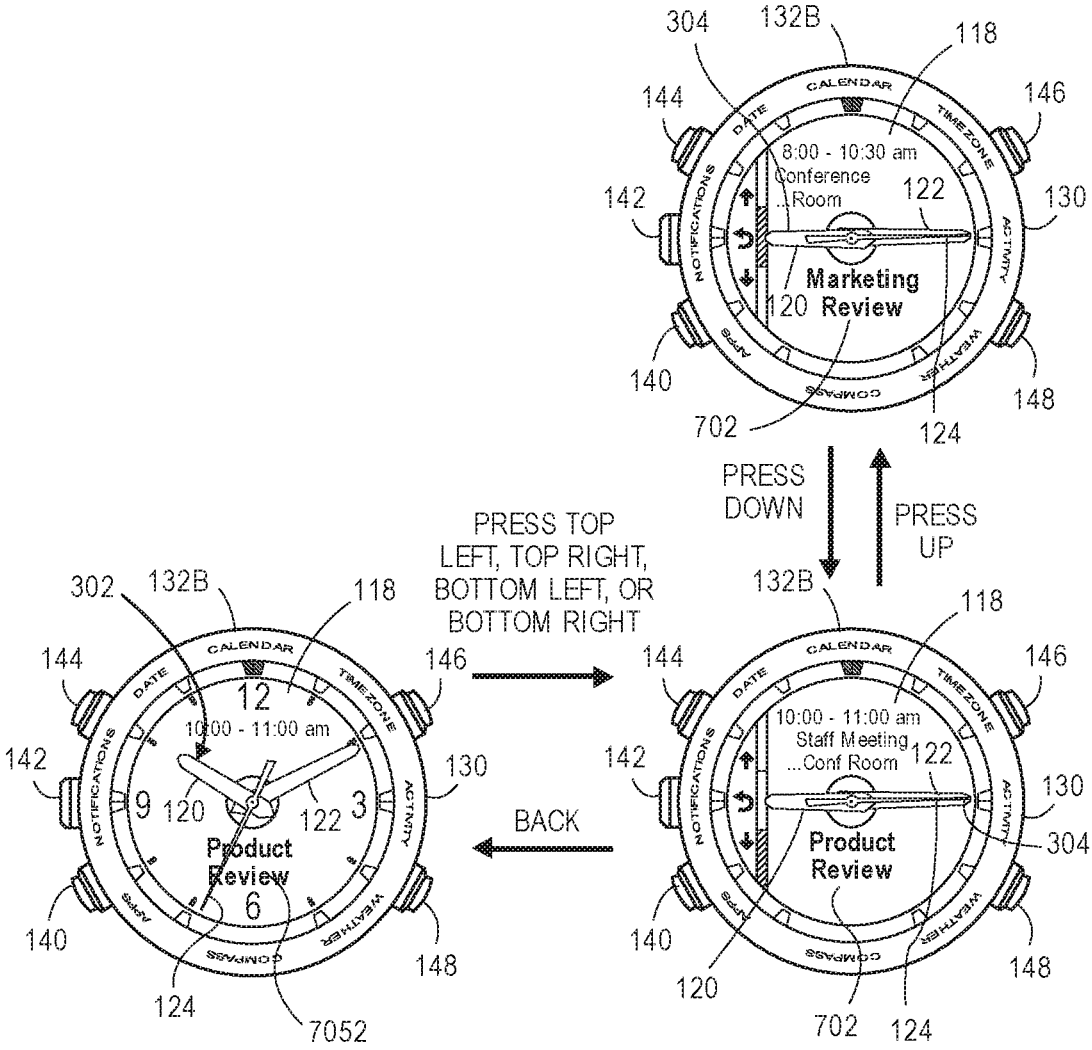

FIGS. 7A and 7B illustrate the smart watch 100 when a calendar mode of operation is selected so that the display device 118 is configured to display at calendar information to the user. As shown, the bezel 130 is rotated to the mode selection "CALENDAR" 132B to select a calendar mode of operation of the smart watch 100. The display device 118 is configured to display calendar information 702, which may include, but is not necessarily limited to: event/appointment reminders (e.g., "Marketing Review," "Product Review," etc.), event/appointment details (e.g., starting and ending times, invitees, geographic location of the event/appointment, notes related to the event/appointment, etc.), calendar related notices (e.g., "No events scheduled today," "No more events scheduled today", etc.), and so forth. In embodiments, the calendar information 702 may be furnished by a calendar application 162 stored in memory 152 and executed by the processor 150 of the smart watch 100, may be furnished by a paired device such as a smart phone, tablet, etc. via the communication system 158, or may be downloaded directly from a service (e.g., through the Internet) via the communication system 158, combinations thereof, and so forth.

As shown, the user may depress a control button (e.g., the top left control button 144, the top right control button 146, the bottom left control button 140, or the bottom right control button 148) to cause the watch arms 120, 122, 124 to be rotated from the timekeeping configuration 302 (a first configuration) where the watch arms 120, 122, 124 rotate in relation to one another to indicate a time of day in the manner of a conventional watch (see FIG. 3A), to the horizontal fixed configuration 304 (a second configuration) to support the display and viewing of calendar information 702 by the display device 118 unobstructed by the watch arms 120, 122, 124. The user may select the top left control button 144 (Up) and/or the bottom left control button 140 (Down) to scroll between entries in the calendar. The user may again depress a control button (e.g., middle left control button 142 (Back)) to cause the watch arms 120, 122, 124 to be rotated from the horizontal fixed configuration 304 back to the timekeeping configuration 302.

Figure 8:
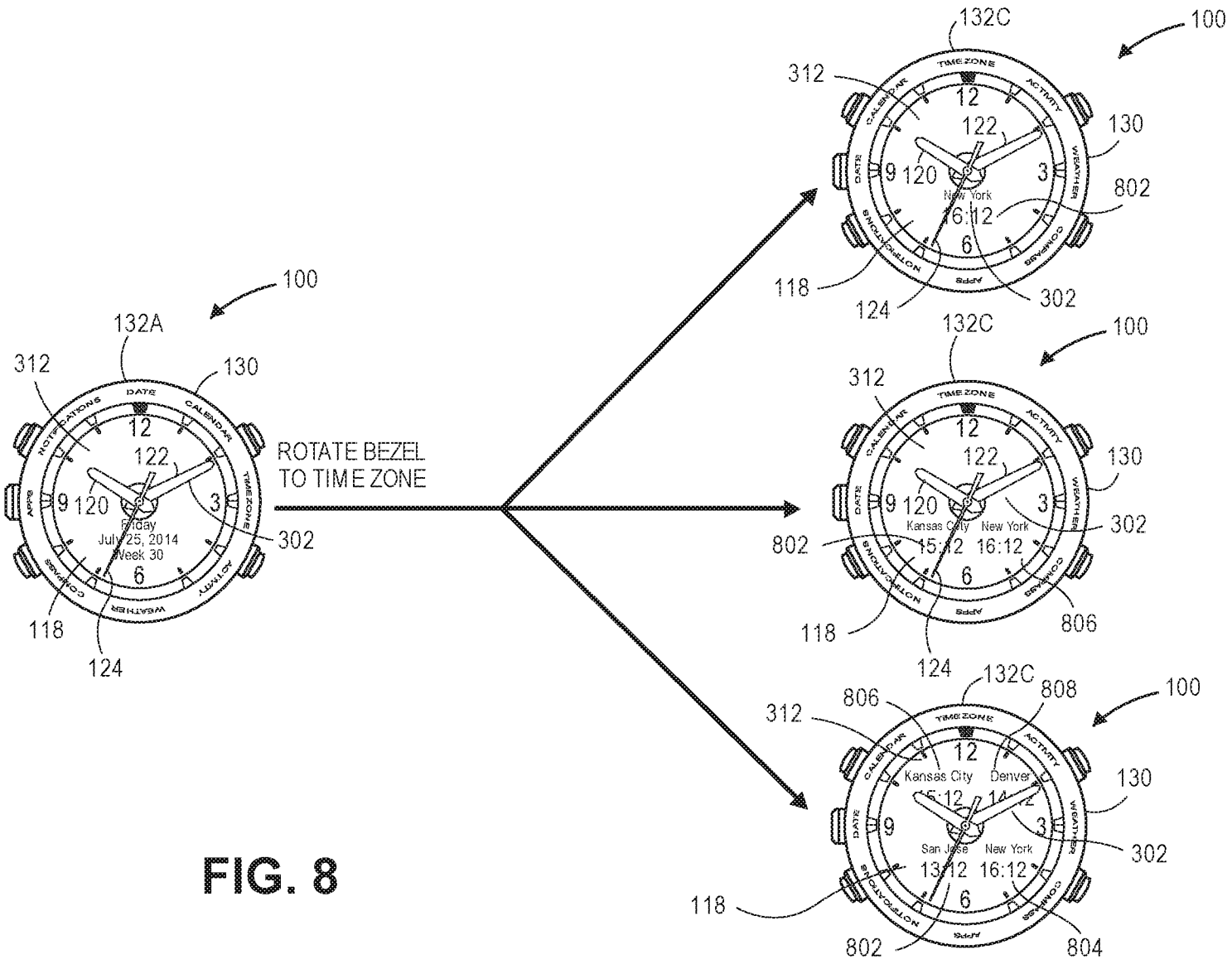
FIG. 8 is a diagrammatic illustration that includes a series of top plan views of the smart watch shown in FIGS. 1A and 1B, further illustrating the smart watch when a time zone mode of operation is selected so that the display device is configured to display the current time in one or more time zones.

FIG. 8 illustrates the smart watch 100 when a time zone mode of operation is selected. As shown, the bezel 130 is rotated to the mode selection "TIME ZONE" 132C to select the time zone mode of operation of the smart watch 100. The first, second, and third watch arms 120, 122, 124 are rotated to the timekeeping configuration 302 to furnish the current time for the time zone in which the smart watch 100 is located (e.g., the current time zone). The display device 118 is configured to display a watch dial 312 with one or more alphanumeric displays 802, 804, 806, 808 that present the current time converted to one or more other time zones. In embodiments, the user may configure the smart watch 100 to select the specific time zones for which the current time is to be converted and displayed. Moreover, the user may configure the smart watch 100 to select the number of time zones for which the current time is to be converted and displayed. For example, as shown in FIG. 8, the user may configure the smart watch 100 to cause the display device 130 to display the current time converted to one, two, or four different time zones. The displayed time zones may be designated by their name (e.g. the "Eastern" time zone, the "Pacific" time zone, etc.) or by a locality such as a major city, a city or town selected by the user, or the like, located within the time zone. In the embodiment shown, the first, second, and third watch arms 120, 122, 124 remain in the timekeeping configuration 302 when the time zone mode of operation is selected. However, in other embodiments, the watch arms 120, 122, 124 may be independently rotated to the three (3) o'clock, six (6) o'clock, and nine (9) o'clock positions to divide the display device 118 into an upper region and a lower region having two quadrants, wherein the alphanumeric displays 802, 804, 806, 808 are positioned in the upper region and lower quadrants to support ease of viewing.

Figure 9:
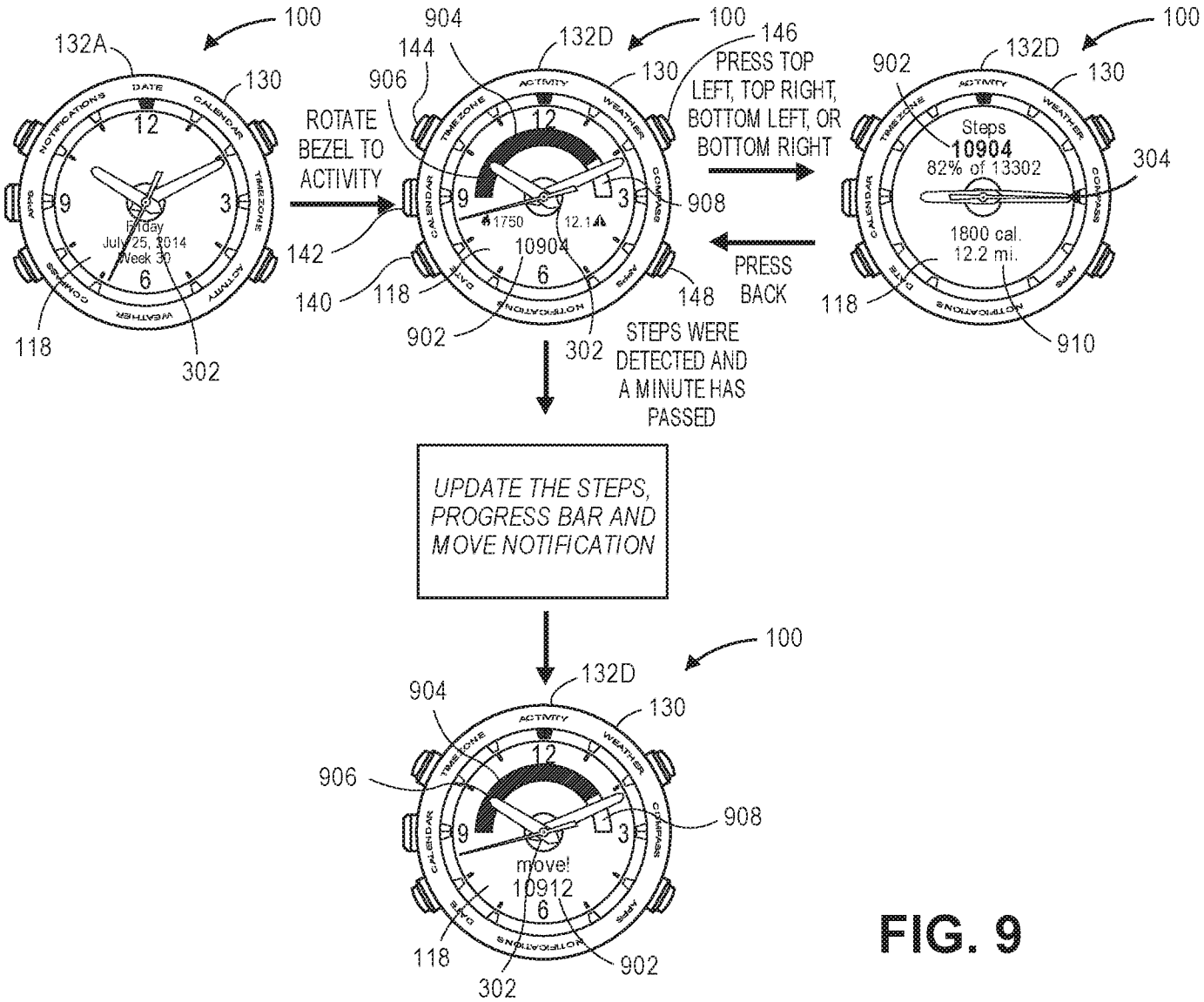
FIG. 9 is a diagrammatic illustration that includes a series of top plan views of the smart watch shown in FIGS. 1A and 1B, further illustrating the smart watch when an activity mode of operation is selected so that the display device is configured to display information indicating the level of activity of the user of the smart watch.

FIG. 9 illustrates the smart watch 100 when an activity mode of operation is selected. As shown, the bezel 130 is rotated to the mode selection "ACTIVITY" 132D to select the activity mode of operation of the smart watch 100. In this mode of operation, the display device 118 is configured to display information that indicates the level of activity of the user. For example, in the embodiment illustrated, the display device 118 may be configured to display the number of steps 902 taken by the user in a predetermined time period (e.g., during the preceding hour, during the current day, over the current month, etc.) as determined by the motion sensor 166 (FIG. 1B). The display device 118 may further be configured to display a dynamic graphical representation of the activity being monitored (e.g., number of steps taken). For example, in the embodiment shown, the display device 118 is configured to display a semi-circular progress bar 904 that indicates the number of steps taken 906 in relation to a goal number of steps to be taken 908. When a period of inactivity is detected (e.g. indicated by the motion sensor 166 (FIG. 1B)), the display device 118 may be configured to display a prompt (e.g., "move!") to encourage the user to undertake the desired activity (e.g., to walk).

As shown, the user may depress a control button (e.g., the top left control button 144, the top right control button 146, the bottom left control button 140, or the bottom right control button 148) to cause the watch arms 120, 122, 124 to be rotated from the timekeeping configuration 302 (a first configuration) to the horizontal fixed configuration 304 (a second configuration) to support the display of additional fitness information 910 by the display device 118 (e.g., calories burned, distance walked, etc.) for viewing by the user unobstructed by the watch arms 120, 122, 124. The user may again depress a control button (e.g., middle left control button 142 (Back)) to cause the watch arms 120, 122, 124 to be rotated from the horizontal fixed configuration 304 (second configuration) back to the timekeeping configuration 302 (first configuration).

Figure 10A:
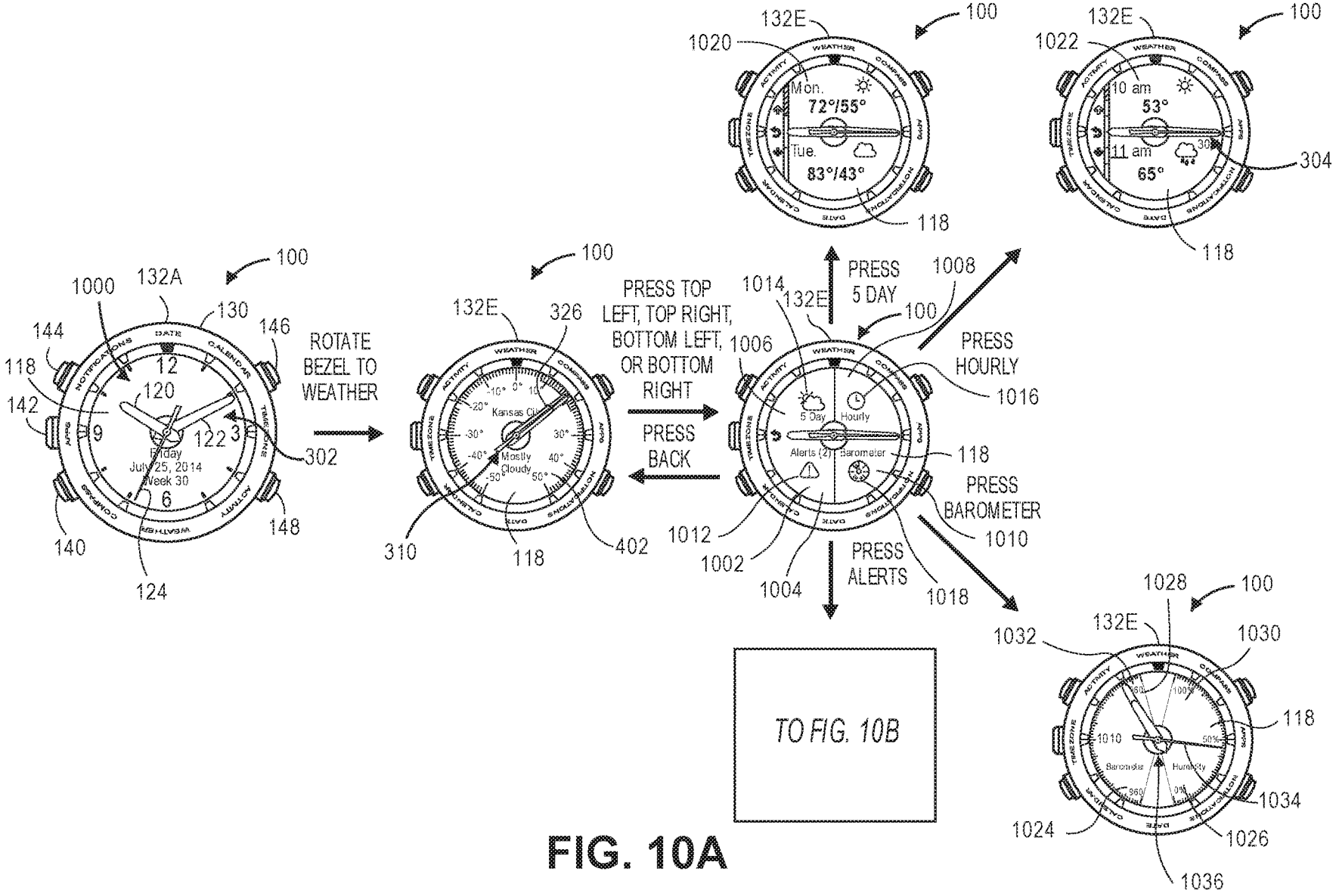
FIGS. 10A and 10B are diagrammatic illustrations that include a series of top plan views of the smart watch shown in FIGS. 1A and 1B, further illustrating the smart watch when a weather mode of operation is selected so that the display device is configured to display weather information.
Figure 10B:
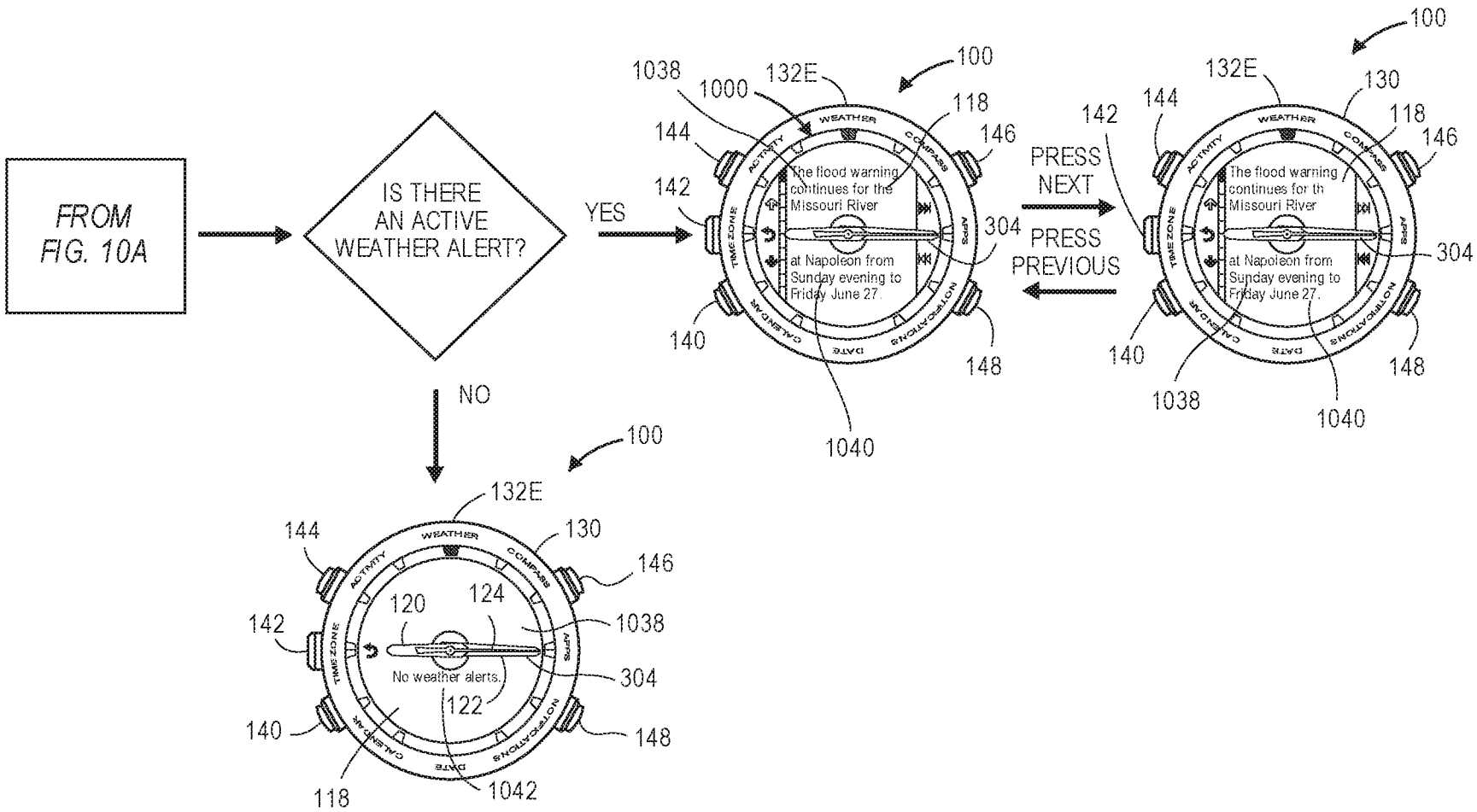

FIGS. 10A and 10B illustrate the smart watch 100 when a weather mode of operation is selected so that the display device 118 is configured to display at weather information. As shown in FIG. 10A, the bezel 130 is rotated to the mode selection "WEATHER" 132E to select a weather mode of operation of the smart watch 100. In embodiments, weather information may be furnished by a weather application 1000, which may be an example of an application 162 stored in memory 152 and executed by the processor 150 of the smart watch 100 (FIG. 1B). Weather information may include, but is not necessarily limited to: weather condition information such as temperature, barometric pressure, wind speed, relative humidity, and so forth; weather condition forecast information such as a three (3), five (5), or ten (10) day weather condition forecasts, hourly weather condition forecasts, and so forth; and/or weather related alert messages such as severe weather alerts issued by the National Weather Service or other similar entity or data provider. The weather information may be received from a paired device such as a smart phone, tablet, or the like via the communication system 158 or may be downloaded directly from a service (e.g., through the Internet) via the communication system 158.

In the embodiment illustrated, the display device 118 is configured to initially display a thermometer (temperature) gauge 402 when the weather mode of operation is selected. The first, second, and third watch arms 120, 122, 124 to be rotated from the time keeping configuration 302 (a first configuration) to the pointer configuration 310 (a second configuration) wherein the watch arms 120, 122, 124 form a movable (rotatable) pointer 326 configured to indicate a temperature on the thermometer gauge 402. The user may again depress a predetermined one of the control buttons (e.g., middle left control button 142 (Back)) to cause the display device 118 to again display the watch dial 312 and the watch arms 120, 122, 124 to be rotated from the pointer configuration 310 (second configuration) back to the timekeeping configuration 302 (first configuration).

In the weather mode of operation, the user may depress a control button other than the control button designated to return the smart watch 100 to the timekeeping mode of operation (e.g., the top left control button 144, the top right control button 146, the bottom left control button 140, or the bottom right control button 148) to cause the display device 118 to display a weather menu 1002. The weather menu 1002 facilitates access by the user to additional weather related functionality furnished by the smart watch 100. In the embodiment shown, the weather menu 1002 may be divided into four quadrants 1004, 1006, 1008, 1010 each having a selectable menu item ("Alerts" 1012, "5-Day" 1014, "Hourly" 1016, and "Barometer" 1018) that corresponds with a respective one of the control buttons (e.g., the bottom left control button 140, the top left control button 144, the top right control button 146, and the bottom right control button 148, respectively) to allow the user to select additional functionality associated with the weather mode of operation.

In FIG. 10A, the watch arms 120, 122, 124 are shown rotated from the pointer configuration 310 (now the first configuration) to the horizontal fixed configuration 304 (now the second configuration) to support the display of the weather menu 1002 by the display device 118 so that viewing of the weather menu 1002 by the user is unobstructed by the watch arms 120, 122, 124. The user may again depress a control button (e.g., middle left control button 142) to cause the display device 118 to again display the thermometer gauge 402 and the watch arms 120, 122, 124 to be rotated from the horizontal fixed configuration 304 (second configuration) back to the pointer configuration 310 (first configuration).

When the weather menu 1002 is displayed, the user may depress the top left control button 144, which corresponds to a first quadrant 1006 of the weather menu 1002, to select the menu item "5-day" 1014. Selection of the 5-day menu item 1014 causes the display device 118 to display a multiple (e.g., "5 day") weather forecast display 1020 that includes weather forecasts for a predetermined number (e.g., five (5)) calendar days. In embodiments, the weather forecasts can include a variety of weather-related information that may be forecast for the time period indicated (e.g., each day of a 5-day forecast). Example weather-related information can include high and low temperatures, barometric pressure, relative humidity, wind speed, wind chill factor, ultraviolet (UV) index, indicia indicating the type of weather conditions forecast (e.g., a sun icon indicating sunny conditions are forecast, a cloud icon indicating cloudy conditions are forecast, a rain icon indicating rainy conditions are forecast, a snowflake icon indicating snowy conditions are forecast, etc.), weather maps, radar maps, combinations thereof, and so forth. The user may select the top left control button 144 and/or the bottom left control button 140 to scroll between the available time periods (e.g., days) of the forecast. The user may select the center left control button 142 to return to the weather menu 1002.

Similarly, from the weather menu 1002, the user may depress the top right control button 144, which corresponds to a second quadrant 1008 of the weather menu 1002, to select the menu item "Hourly" 1016. Selection of the Hourly menu item 1016 causes the display device 118 to display an hourly weather forecast display 1022 that includes hour-by-hour weather forecasts for a predetermined period of time (e.g., the next calendar day). In embodiments, the forecast information can include information such as expected temperature, indicia indicating the type of weather conditions forecast (e.g., a sun indicating sunny conditions, a cloud indicating cloudy conditions, rain indicating rainy conditions, a snowflake indicating snowy conditions, etc.), wind speed and direction, wind chill, barometric pressure, relative humidity, combinations thereof, and so forth. The user may select the top left control button 144 and/or the bottom left control button 140 to scroll between the hours of the forecast, and the center left button 142 to return to the weather menu 1002.

From the weather menu 1002, the user may further depress the bottom right control button 148, which corresponds to a third quadrant 1010 of the weather menu 1002, to select the menu item "Barometer" 1018. Selection of the Barometer menu item 1018 causes the display device 118 to display barometer and humidity gauges 1024, 1026, respectively, to furnish ambient barometric pressure and/or humidity information to the user of the smart watch 100. In the embodiment shown, the barometer and humidity gauges 1024, 1026 are displayed as opposed, pie-shaped sectors 1028, 1030 having pointers 1032, 1034 formed by the watch arms 120, 122, 124. More specifically, in the embodiment shown, the watch arms 120, 122, 124 are placed in an example configuration (hereinafter the "dual pointer configuration" 1036), wherein the positions of the first and second watch arms 120, 122 are fixed with respect to one another, with the second watch arm 122 overlaying (or underlying) the first watch arm 120 to form the first pointer 1032, which is configured to indicate a barometric pressure on the barometer gauge 1024. The third watch arm 124 may rotate independently of the first and second watch arms 120, 122 to form the second pointer 1034, which is configured to indicate a relative humidity reading on the humidity gauge 1026. The user may again depress a control button (e.g., middle left control button 142) to cause the weather menu 1002 to be displayed and the watch arms 120, 122, 124 to be rotated from the dual pointer configuration 1036 back to the horizontal fixed configuration 304.

Still further, from the weather menu 1002, the user may depress the bottom left control button 140, which corresponds to a fourth quadrant 1004 of the weather menu 1002 to select the menu item "Alerts" 1012. As shown in FIG. 10B, selection of the Alerts menu item 1012 causes the display device 118 to display a weather alerts page 1038 that furnishes weather related alert messages 1040 such as severe weather alerts broadcast by the National Weather Service, or the like, or, if no alerts have been issued, a message (e.g., "No Weather Alerts.") 1042 informing the user that that no alerts are issued. If more than one alert is available (issued), the user may select the top left control button 144 and/or the bottom left control button 140 to cause the weather alerts page 1038 to scroll through (up and/or down, respectively) the alert messages 1040. As shown, the watch arms 120, 122, 124 may remain rotated to the horizontal fixed configuration 304.

Figure 11:
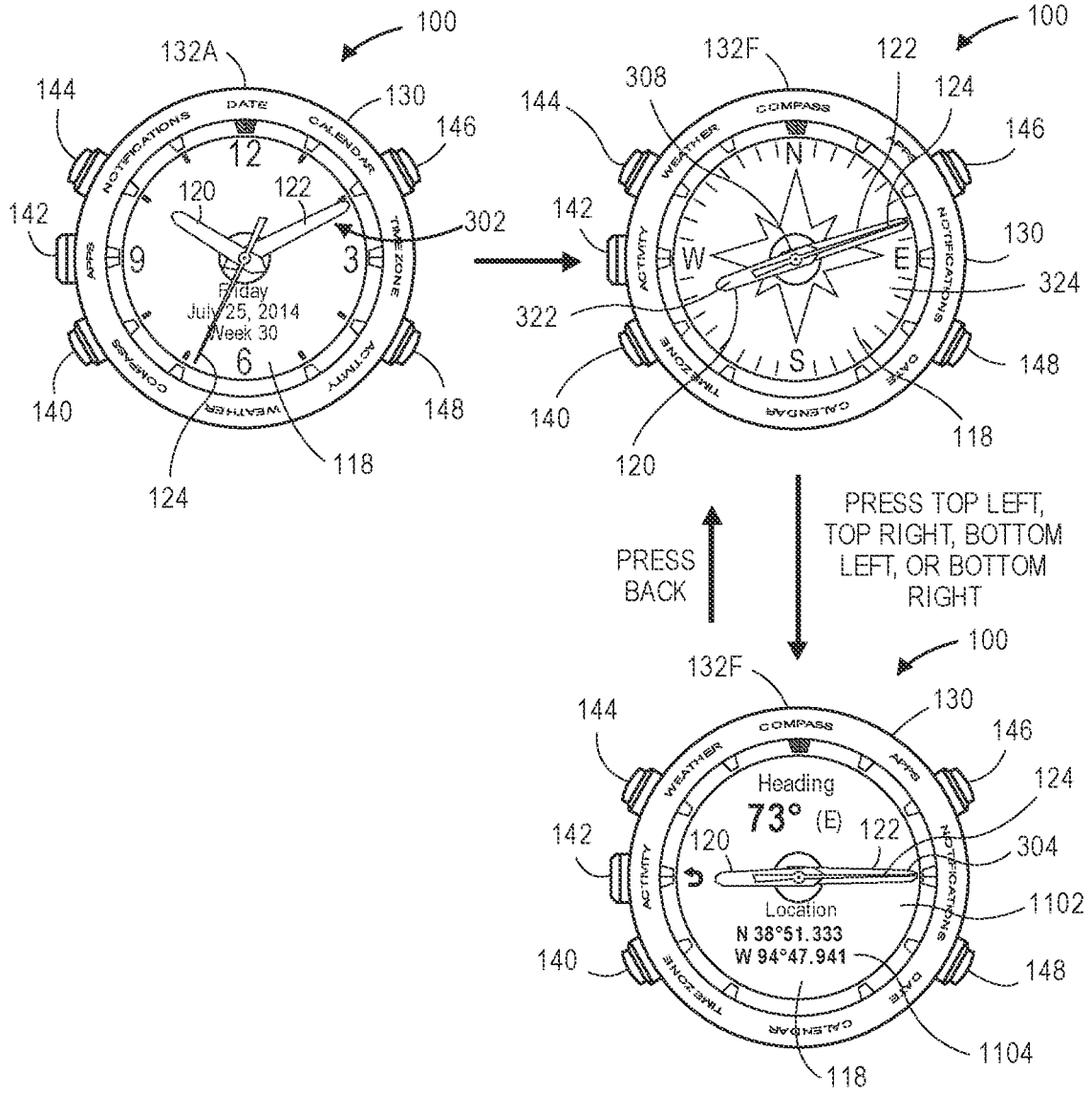
FIG. 11 is a diagrammatic illustration that includes a series of top plan views of the smart watch shown in FIGS. 1A and 1B, further illustrating the smart watch when a compass mode of operation is selected so that the display device is configured to display a compass rose, and the watch arms are configured to function as a compass needle.

FIG. 11 illustrates the smart watch 100 when a compass mode of operation is selected. As shown, the bezel 130 is rotated to the mode selection "COMPASS" 132F to select a compass mode of operation of the smart watch 100. The display device 118 is configured to display a compass rose 324, and the watch arms are rotated from the timekeeping configuration 302 (a first configuration) to the needle configuration 308 (a second configuration) to function as a compass needle 322 for indicating a direction or heading on the compass rose 324 as determined by the position determining system 154 (see FIG. 1B). The compass rose 324 may include directional indicators (e.g., "N" for North, "S" for South, "E" for East, and "W" for West, etc.) and/or other information that may be used to navigate (e.g., direction to destination, distance to next directional change, etc.).

As shown, the user may depress a control button (e.g., the top left control button 144, the top right control button 146, the bottom left control button 140, or the bottom right control button 148) to cause the display device 118 to replace the compass rose 324 with a navigation page 1102 that includes location/navigation information 1104. In embodiments, the location/navigation information 1104 may include position (e.g., latitude, longitude, and/or altitude; a nearest street address; etc.), a heading, a direction of travel (e.g., North, South, East, West, Northeast, Northwest, Southeast, Southwest, etc.), a route, route guidance, a moving map which may display a route, combinations thereof, and so forth), or other information that may be used to navigate (e.g., direction to destination, distance to next directional change, etc.). In embodiments, the first, second, and third watch arms 120, 122, 124 may be rotated to one of the needle configuration 308 or pointer configuration 310 to provide a needle 322 or pointer 326 configured to point to a direction or bearing of a GPS waypoint, point of interest (POI) or non-stationary position (e.g., a position corresponding to a current geographic location of a friend). The display device 118 and/or the watch arms 120, 122, 124 may also be configured to provide avionic functionality to pilot users. Such functionality may include a speed indication, an altitude indication, an aircraft attitude, a VHF Omni Directional Radio Range (VOR) indication, a Course Deviation Indicator (CDI) indication, or any other avionic indication that may aid a pilot.

In embodiments, the watch arms 120, 122, 124 may be rotated from the needle configuration 308 (now the first configuration) to the horizontal fixed configuration 304 (now the second configuration) so that the location/navigation information 1104 may be viewed by the user of the smart watch 100 unobstructed by the watch arms 120, 122, 124. In other embodiments, the needle 322 formed by the watch arms 120, 122, 124 when rotated to the needle configuration 308, may automatically rotate to any position to indicate a current heading of the smart watch 100, or provide any of the above-mentioned functionalities when held in a predetermined position, such as facing the user while the user's arm is held parallel to the ground. In further embodiments, the watch arms 120, 122, 124 may rotate to a fixed configuration, such as the vertical fixed configuration 306, and display device 118 may be configured to display directional indicators which may rotate with respect to the fixed watch arms 120, 122, 124 to provide the current direction of movement of the smart watch 100.

The user may again depress a control button (e.g., middle left control button 142) to cause the display device 118 to again display the compass rose 324, and the watch arms 120, 122, 124 to be rotated from the horizontal fixed configuration 304 (second configuration) back to the needle configuration 308 (first configuration).

Figure 12:
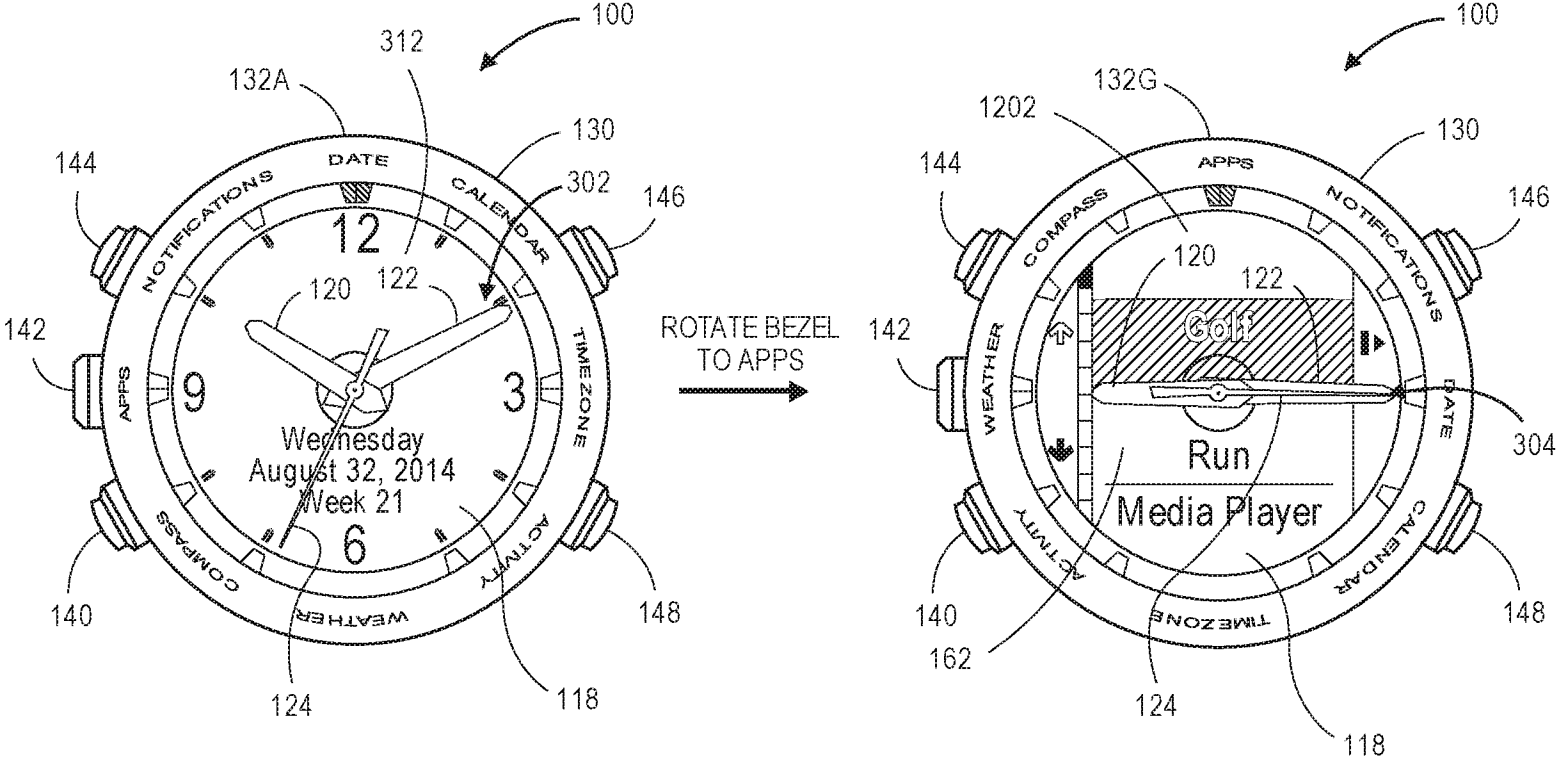
FIG. 12 is a diagrammatic illustration that includes a series of top plan views of the smart watch shown in FIGS. 1A and 1B, further illustrating the smart watch when an application selection mode of operation is selected so that the display device is configured to display a selection of available applications.

FIG. 12 illustrates the smart watch 100 when an application mode of operation is selected. As shown, the bezel 130 is rotated to the mode selection "APPS" 132G to select the apps mode of operation of the smart watch 100. The display device 118 is configured to display an app selection page 1202 that provides a scrollable listing of available apps 162. The watch arms 120, 122, 124 to be rotated from the timekeeping configuration 302 (a first configuration) where the watch arms 120, 122, 124, to the horizontal fixed configuration 304 (a second configuration) to support the display of the app selection page 1202 by the display device 118 so that viewing of the app selection page 1202 is unobstructed by the watch arms 120, 122, 124. The user may depress the top left control button 144 and/or the bottom left control button 140 to scroll between the applications 162 listed on the app selection page 1202 to select an application 162 from the list. The selected application 162 may be indicated within the list (e.g., by highlighting, changing color, bolding, etc. the selected application 162) to indicate its selection. The user may depress the upper right control button 146 to cause the application 162 to be executed by the processor 150 (FIG. 1B). The user may again depress a control button (e.g., middle left control button 142) to cause the display device 118 to again display the watch dial 312, and the watch arms 120, 122, 124 to be rotated from the horizontal fixed configuration 304 (second configuration) back to the timekeeping configuration 302 (first configuration).

When an application 162 is selected, the display device 118 may display any information associated with an application 162. As noted in the discussion of FIG. 1B, the application may be stored in memory 152 of the smart watch 100 and executed by the processor 150. In embodiments, an instance of the application 162 may also be running (stored in memory 152 and/or executed by a processor 150) on a remote device such as a paired device (e.g., a paired smart phone), a remote server, or the like. Additional information associated with the application may be stored on a remote device and accessed using the communication system 158, which may send and receive data from the remote device. The watch arms 120, 122, 124, may automatically rotate to a configuration to partition the display as required by the application 162 as described in the discussion of FIGS. 3A through 3E.

FIGS. 13A through 19B illustrate functionality implemented by example applications 162 that may be selected from the app selection page 1202 to be executed by the smart watch 100. As noted in the discussion of FIG. 1B, applications 162 can comprise software, which is storable in memory 152 and executable by the processor 150, to perform a specific operation or group of operations to furnish functionality to the smart watch 100. Applications 162 may be downloaded into memory 152 from a service, such as an online application store, or the like, through the Internet, via the communication system 158 via a connection with a paired device, through a communications network (e.g., Wi-Fi), or the like. It will further be appreciated that the applications 162 shown and described herein are examples of possible applications 162, and are not meant to be exhaustive of the number or kinds of applications 162 that may be executed by the smart watch 100. Instead, it is contemplated that any number of applications 162 may be available to be stored in memory 152 for execution by the processor 150 of the smart watch 100. These applications 162 may be listed in the app selection page 1202 when the app selection mode of operation is selected.

Figure 13A:
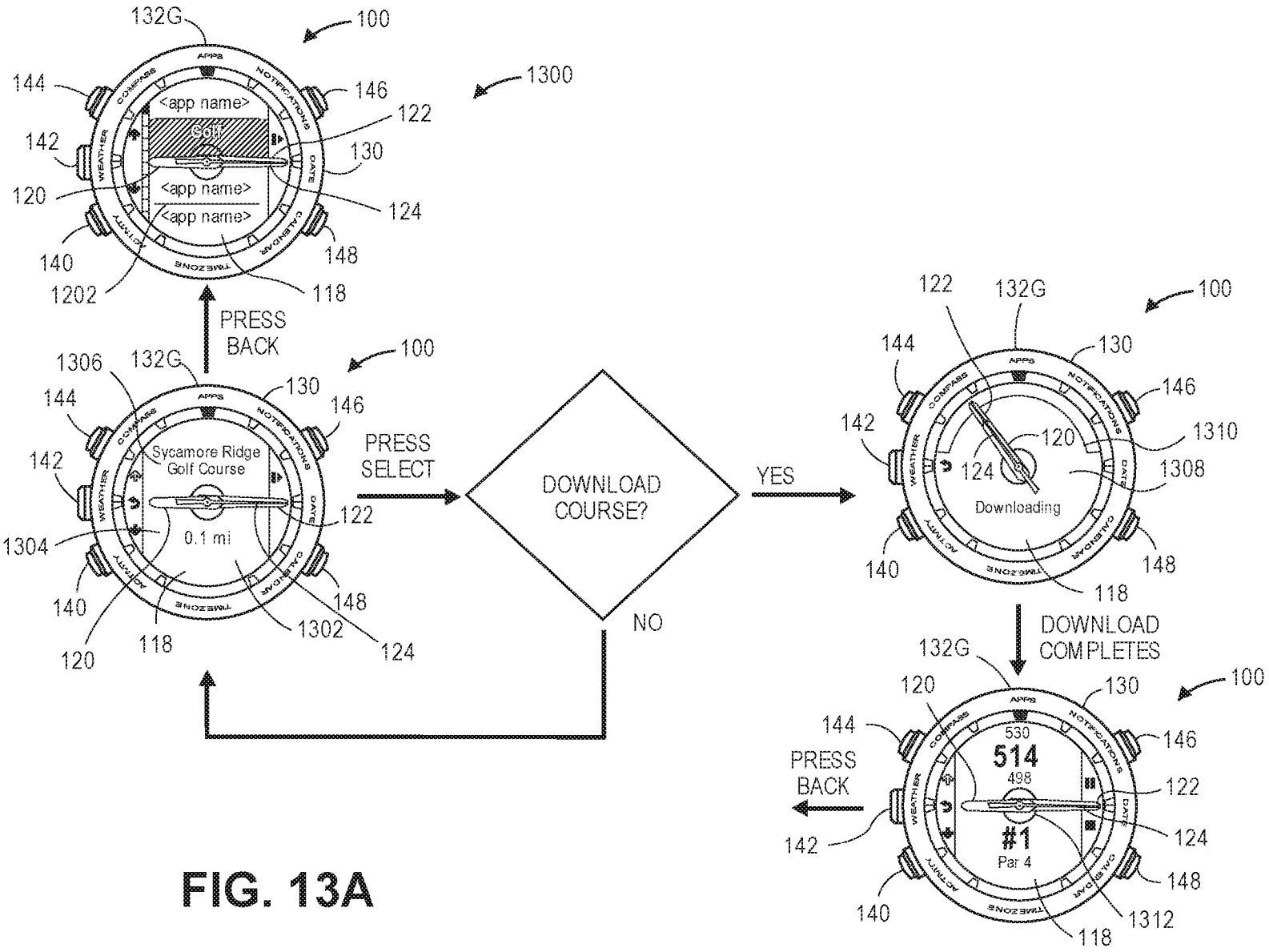
FIGS. 13A and 13B are diagrammatic illustrations that include a series of top plan views of the smart watch shown in FIGS. 1A and 1B, further illustrating the smart watch configured to execute a golf application.
Figure 13B:
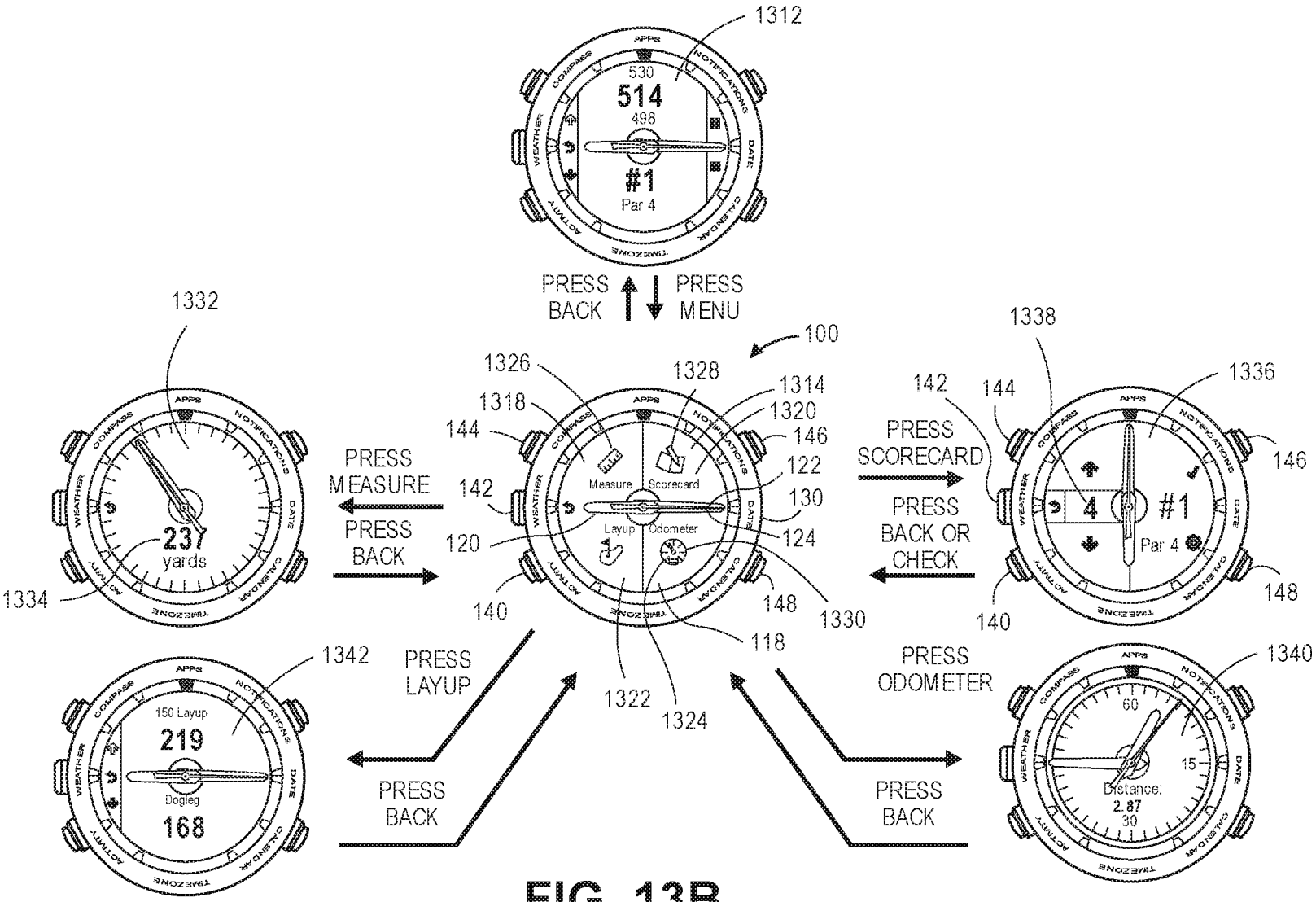

FIGS. 13A and 13B illustrate the smart watch 100 configured to execute a golf application 1300. As shown, the bezel 130 is rotated to the mode selection "APPS" 132G to select the apps mode of operation of the smart watch 100, and a golf application 1300 is selected from the app selection page 1202 as discussed in the description of FIG. 12. The display device 118 initially displays course selection page 1302 that includes a list 1304 containing entries describing one or more golf courses 1306 that may be selected by the user of the smart watch 100 as the course the user desires to play. In embodiments, the list 1304 of golf courses 1306 may be sorted based on their respective distances from the user as determined by the position determining system 154 (see FIG. 1B). As shown, the distance from the user (as determined by the position determining system 154 (see FIG. 1B)) may be displayed for each golf course 1306 included within the list 1304. However, entries for golf courses 1306 listed by the list 1304 may be sorted in other ways. For example, in embodiments (not shown), the user may configure the smart watch 100 to cause the entries for golf courses 1306 to be sorted in alphabetical order, by green fees charged by the golf course (cost), by difficulty (par rating), by user rating via an Internet-based rating service, and so forth.

The user may depress the top left control button 144 and/or the bottom left control button 140 to scroll between the golf courses 1306 listed in the list 1304 to select a golf course 1306 to be played. The selected golf course 1306 may be indicated within the list (e.g., by highlighting, changing color, bolding, etc., the selected course 1306) to indicate its selection. The user may then depress the upper right control button 146 to cause the golf application 1300 to select the indicated golf course 1306 as the course 1306 to be played. As shown in FIG. 13A, the watch arms 120, 122, 124 remain in the horizontal fixed configuration 304 (a second configuration) to support the display of the list 1304 by the display device 118 so that viewing of the list 1304 is unobstructed by the watch arms 120, 122, 124.

When information describing the selected golf course 1306 is already stored in memory 152 (FIG. 1B) of the smart watch 100 and/or a paired device (e.g., the selected golf course has been played before), the display device 118 may be configured to display a main page 1312 providing information relevant to the hole of the golf course 1306 currently being played (e.g., fairway (hole) number, distance to the flag from the tee box (which may be determined as the center of the golf green or set by the user), distance to the front of the green from the tee box, distance to the back of the green from the tee box, par rating for the hole, and so forth). The first, second, and third watch arms 120, 122, 124 remain in the horizontal fixed configuration 304. The user may again depress a predetermined one of the control buttons (e.g., middle left control button 142) to cause the display device 118 to again display the app selection page 1202.

When information describing the selected golf course 1306 is not stored in memory 152 of the smart watch 100 and/or a paired device, the information may then be downloaded. The information downloaded and/or stored may include, but is not limited to: the number of holes of golf available at the golf course; the par rating of each hole of golf, the distance of each hole of golf, locations of fairway features (e.g., tee boxes, sand and water traps, other obstructions, greens, and pins), pin placement, maps of the golf course fairways, combinations thereof, and so forth. While the information is being downloaded, the display device 118 may display a download status page 1308 that indicates the status of the download operation. For example, in the embodiment shown in FIG. 13A, the download status page 1308 may include a semi-circular download status icon 1310, while the first, second, and third watch arms 120, 122, 124 are rotated from the horizontal fixed configuration 304 (a first configuration) to a pointer configuration 310 to furnish an indication of the download status with respect to the status icon 1310.

When the download of information is complete, the display device 118 may be configured to display the main page 1312 as discussed above. The first, second, and third watch arms 120, 122, 124 are rotated from the pointer configuration 310 the horizontal fixed configuration 304. The user may again depress a predetermined one of the control buttons (e.g., middle left control button 142) to cause the display device 118 to again display the course selection page 1302.

The user may depress a control button other than the control button designated to return the smart watch 100 to the timekeeping mode of operation (e.g., the top left control button 144, the top right control button 146, the bottom left control button 140, or the bottom right control button 148) to cause the display device 118 to display a golf menu 1314. The golf menu 1314 facilitates access by the user to additional golf related functionality furnished by the smart watch 100. In the embodiment shown, the golf menu 1314 may be divided into four quadrants 1316, 1318, 1320, 1322 each having a selectable menu item ("Layup" 1324, "Measure" 1326, "Scorecard" 1328, and "Odometer" 1330) that corresponds with a respective one of the control buttons (e.g., the bottom left control button 140, the top left control button 144, the top right control button 146, and the bottom right control button 148, respectively) to allow the user to select additional functionality associated with the golf application 1300.

When the golf menu 1314 is displayed, the user may depress the top left control button 144, which corresponds to a first quadrant 1318 of the golf menu 1314, to select the menu item "Measure" 1326. Selection of the Measure menu item 1326 causes the display device 118 to display a measure page 1332 configured to indicate a distance 1334 of a shot taken by the user as determined by the position determining system 154 (see FIG. 1B) of the smart watch 100. For example, after hitting a shot, the user may depress the top left control button 144, the top right control button 146, the bottom left control button 140, or the bottom right control button 148 to cause the smart watch 100 to determine and store the position of the shot, and to begin to measure the distance from the stored position to the position of the user's golf ball. As the user walks to the position of the golf ball, the distance 1334 from the stored position where the control button 144, 146, 140, 148 was pressed is determined by the position determining system 154 (see FIG. 1B) and displayed. When the user reaches his/her golf ball, the distance displayed corresponds to the distance of the shot. As the user walks, the first, second, and third watch arms 120, 122, 124 are rotated to the pointer configuration 310 to furnish a pointer 326 that indicates the direction or heading to the flag of the fairway (hole) being played.

Similarly, from the golf menu 1314, the user may depress the top right control button 146, which corresponds to a second quadrant 1320 of the golf menu 1314, to select the menu item "Scorecard" 1328. Selection of the Scorecard menu item 1328 causes the display device 118 to display a scorecard page 1336 that furnishes scorekeeping functionality. As shown, the user may depress one or more control buttons (e.g., the upper left control button 144 and the lower left control button 140, respectively) to increment and/or decrement a score display 1338 for the hole being played. Another control button (e.g., the upper right control button 146) may be depressed to enter the score for the hole, and cause a scorecard page 1336 to be displayed for the next hole. In embodiments, the score initially displayed by the scorecard page 1336 may be the par score for the hole, zero (0), a score previously entered or saved by the user (e.g., a previous low score), or the like, which may then be incremented or decremented by the user.

From the golf menu 1314, the user may further depress the bottom right control button 148, which corresponds to a third quadrant 1322 of the golf menu 1314, to select the menu item "Odometer" 1330. Selection of the Odometer menu item 1330 causes the display device 118 to display an odometer page 1340. The odometer page 1340 may, for example, furnish the user with an indication of the distance the user has walked while playing the round of golf. As shown, the watch arms 120, 122, 124 may remain rotated to the timekeeping configuration 302.

Still further, from the golf menu 1314, the user may depress the bottom left control button 140, which corresponds to a fourth quadrant 1316 of the golf menu 1314 to select the menu item "Layup" 1324. Selection of the Layup menu item 1324 causes the display device 118 to display a layup page 1342 which provides distance information for the fairway being played to assist the user in hitting a layup shot. As shown, the watch arms 120, 122, 124 may remain rotated to the horizontal fixed configuration 304. For example, the layup page 1342 may be configured to display the distance from the tee box to various layup points from the green (e.g., a 100 yard layup from the center of the green or the flag, a 150 yard layup from the center of the green or the flag, a 200 yard layup from the center of the green or the flag, etc.). As shown, the user may depress one or more control buttons (e.g., the upper left control button 144 and the lower left control button 140, respectively) to increment and/or decrement the distance of the layup point from the green. In embodiments, the layup page may further be configured to display the distance to a dogleg in the fairway if one exists.

Figure 14:
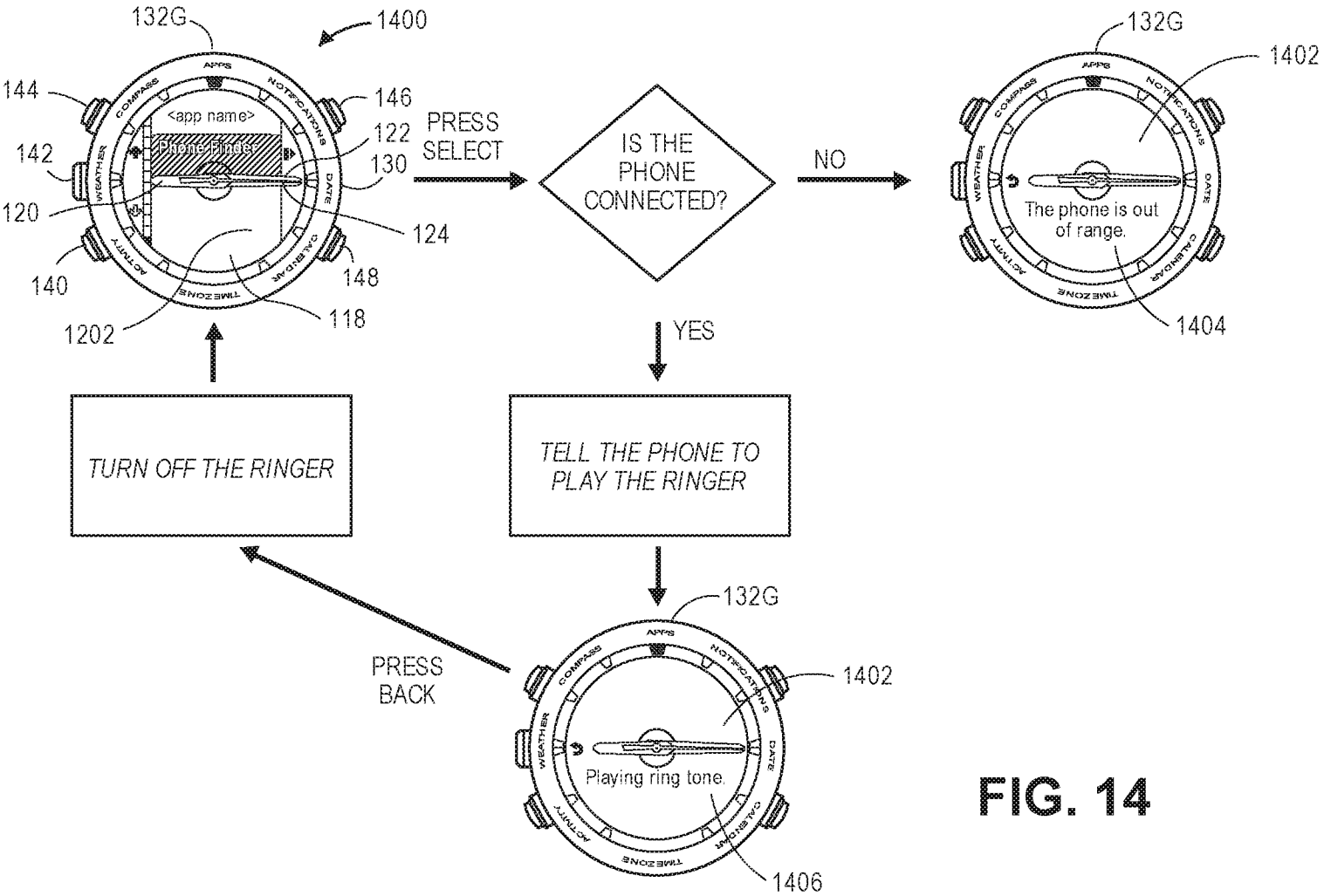
FIG. 14 is a diagrammatic illustration that includes a series of top plan views of the smart watch shown in FIGS. 1A and 1B, further illustrating the smart watch configured to execute a phone finder application.

FIG. 14 illustrates the smart watch 100 configured to execute a phone finder application 1400. As shown, the bezel 130 is rotated to the mode selection "APPS" 132G to select the apps mode of operation of the smart watch 100, and a phone finder application 1400 is selected from the app selection page 1202 as discussed in the description of FIG. 12. In embodiments, the phone finder application 1400 may cause a request to be sent from the smart watch 100 to a paired device such as a paired smart phone or tablet via the communication system 158 to cause to paired device (paired smart phone or tablet) to play a ring tone, thereby allowing the user of the smart watch to locate the paired device. As shown, the display device may display a phone finder page 1402 that furnishes a message 1404, 1406 indicating the status of the request (e.g., "Playing ring tone." when the request is successfully transmitted, or "The phone is out of range." when the paired device (paired smart phone or tablet) is out of range of the communication system 158). As shown, the watch arms 120, 122, 124 may remain rotated to the horizontal fixed configuration 304. The user may again depress a predetermined one of the control buttons (e.g., middle left control button 142 (Back)) to cause the display device 118 to again display the app selection page 1202.

Figure 15:
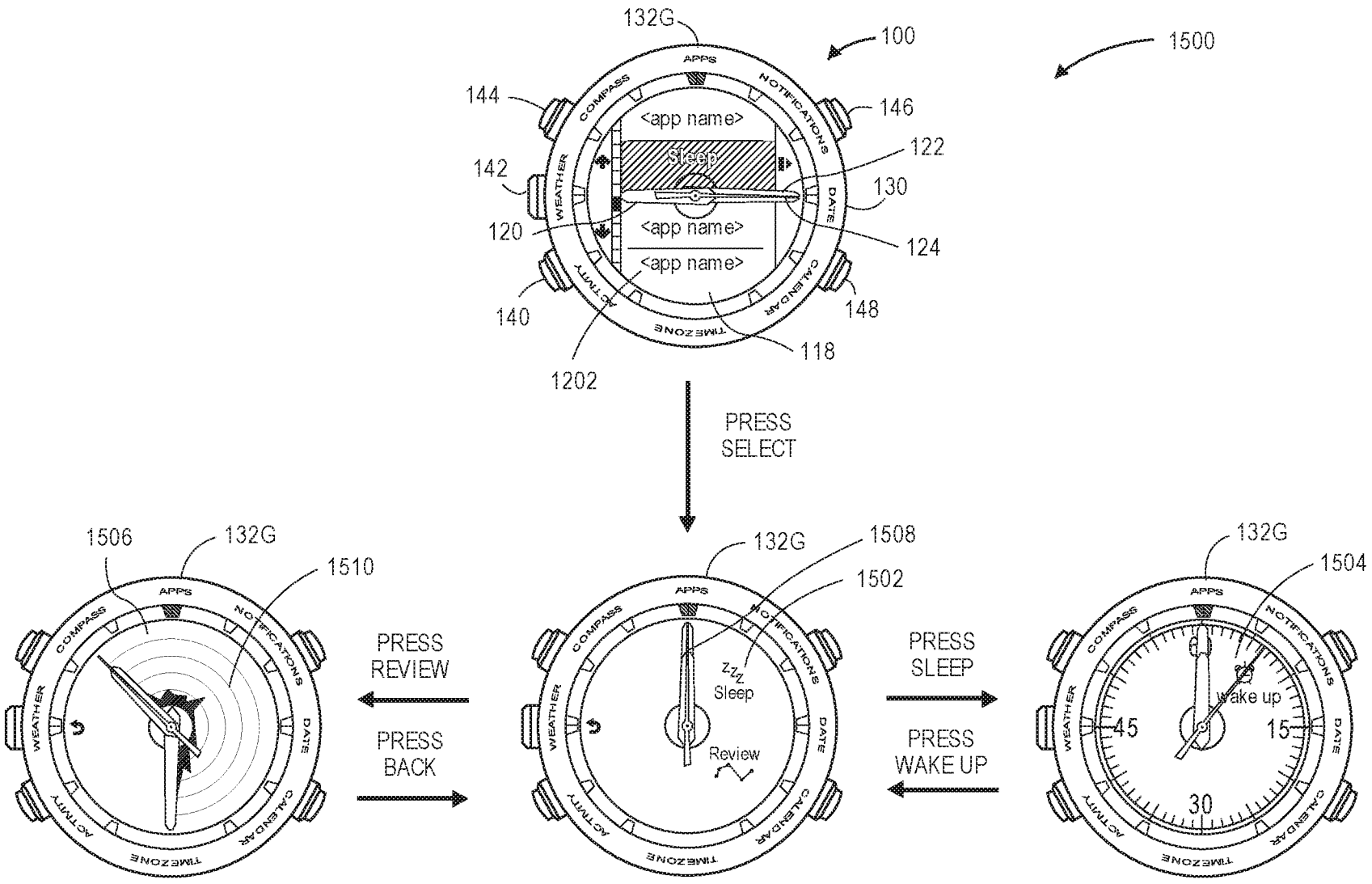
FIG. 15 is a diagrammatic illustration that includes a series of top plan views of the smart watch shown in FIGS. 1A and 1B, further illustrating the smart watch configured to execute a sleep application.

FIG. 15 illustrates the smart watch 100 configured to execute a sleep application 1500. As shown, the bezel 130 is rotated to the mode selection "APPS" 132G to select the apps mode of operation of the smart watch 100, and a sleep application 1500 is selected from the app selection page 1202 as discussed in the description of FIG. 12. In embodiments, the sleep application 1500 causes the display device 118 to display a sleep menu page 1502 that provides access to functionality to track and record information related to the user's sleep. For example, from the sleep menu page 1502, the user may activate the sleep application 1500 by depressing a control button (e.g., the upper right control button 146 ("Sleep")) prior to going to sleep to enter a sleep mode, and again upon waking ("Wake up"). While the sleep menu page 1502 is displayed, the watch arms 120, 122, 124 are rotated to a half vertical fixed configuration 1508 (or another configuration) as required by the sleep application 1500 to support viewing of the "Sleep" and "Review" indicia displayed by display device 118. In the embodiment illustrated, while the sleep application 1500 is in the sleep mode, the sleep application 1500 configures the display device 118 to display a sleep timer page 1504 that includes count up timer indicia (e.g., the numbers "15," "30," "45," "60," and associated tick marks spaced about the periphery of the display device 118). The watch arms 120, 122, 124 independently rotate with respect to the sleep timer page to indicate, for example, the amount of time the user has slept since the sleep mode was entered (with the first watch arm (the hour hand) 120 indicating hours slept, the second watch arm (the minute hand) 122 indicating minutes, and the third watch arm (sweep or second hand) indicating seconds slept. From the sleep menu page 1502, the user may depress a second control button (e.g., the lower right control button 148 ("Review")) to display a sleep review page 1506 which presents graphical indicia (e.g., indicia comprised of a series of partial concentric rings are shown) 1510. The watch arms 120, 122, 124 are independently rotated with respect to the graphical to display the sleep information obtained by the smart watch 100. From the sleep menu page 1502, the user may again depress a predetermined one of the control buttons (e.g., middle left control button 142) to cause the display device 118 to again display the app selection page 1202.

Figure 16:
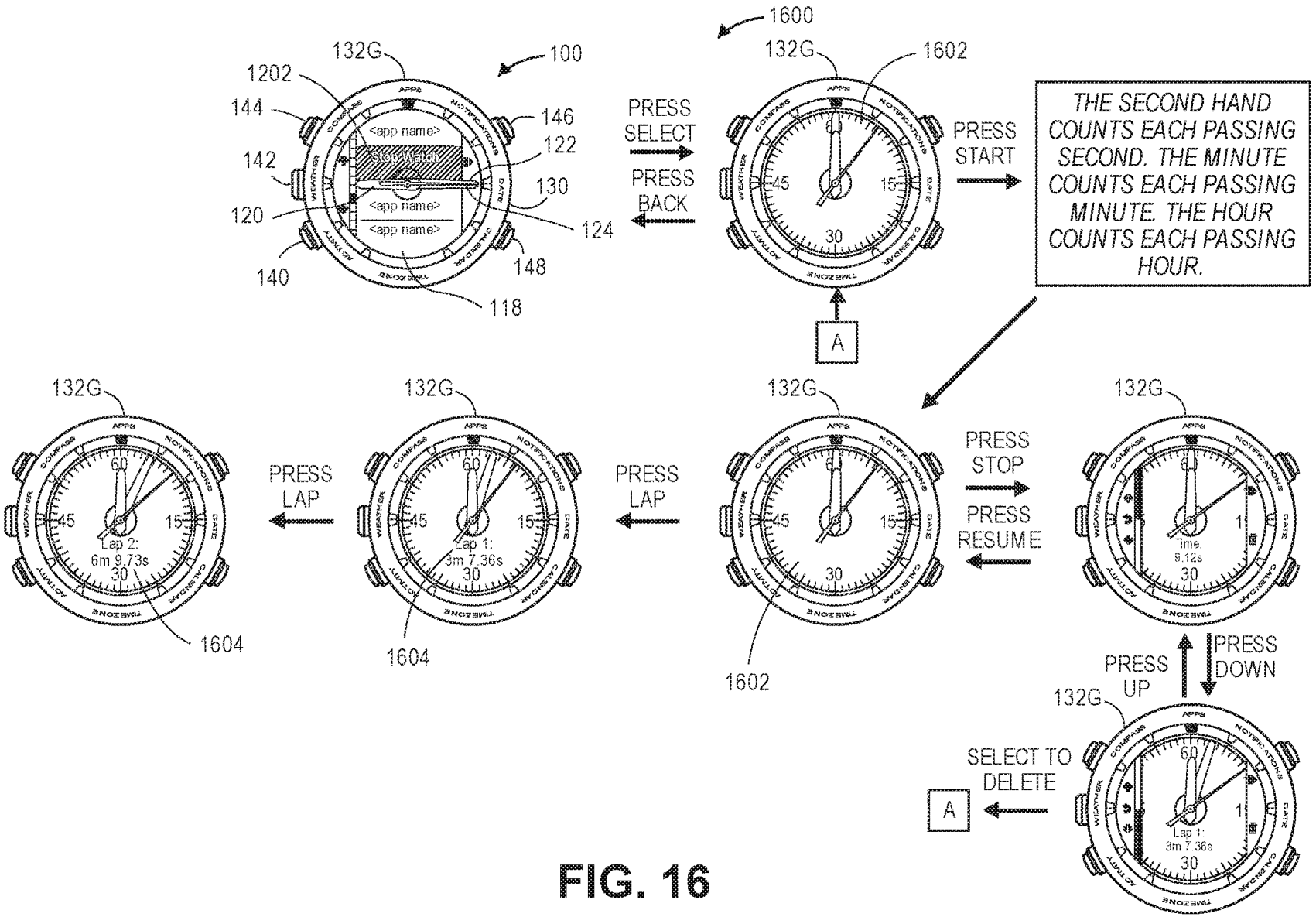
FIG. 16 is a diagrammatic illustration that includes a series of top plan views of the smart watch shown in FIGS. 1A and 1B, further illustrating the smart watch configured to execute a stopwatch application.

FIG. 16 illustrates the smart watch 100 configured to execute a stopwatch application 1600. As shown, the bezel 130 is rotated to the mode selection "APPS" 132G to select the apps mode of operation of the smart watch 100, and a stopwatch application 1600 is selected from the app selection page 1202 as discussed in the description of FIG. 12. The display device 118 is configured to display a stopwatch page 1602 containing information associated with stopwatch functionality. For example, the stopwatch page 1602 may include a stopwatch (count up timer) function, lap timing functions (e.g., lap time for a current lap, time splits, etc.), and so forth. The watch arms 120, 122, 124 may be rotated from the horizontal fixed configuration 304 and placed in a timekeeping configuration 302 wherein the third watch arm 124 may indicate seconds elapsed, the second watch arm 122 may indicate minutes elapsed, and the first watch arm 120 may indicate hours elapsed. Further, the stopwatch page 162 may be configured to display an alphanumeric readout 1604 of the time elapsed, which may include a display of fractions of a second (e.g., tenths of a second elapsed, hundredths of a second, thousandths of a second, etc.). When depressed, the control buttons (e.g., the top left control button 144, the top right control button 146, the bottom left control button 140, or the bottom right control button 148) may configured to start and/or stop the stopwatch timer, temporarily stop the stopwatch timer to obtain a split, reset the stopwatch timer to zero (e.g., 00:00:00:00), and so forth. For example, in an embodiment, the user may depress the top right control button 146 (Start) to start the stopwatch function. While the stopwatch is counting up, the user may depress the top left control button 144 (Lap) one or more times to obtain one or more split or lap times. The user may again depress the top right control button 146 (Stop) to stop the stopwatch and show the end time. When the stopwatch is stopped, the user may then depress the bottom left control button 140 (Up) and/or the top left control button 144 (Down) to scroll between the end time and the one or more lap/split times recoded by the stopwatch. The user may then depress the bottom left control button 140 (Delete) to clear (delete) the end and lap times. Moreover, the user may depress a predetermined one of the control buttons (e.g., middle left control button 142) to cause the display device 118 to again display the app selection page 1202.

Figure 17:
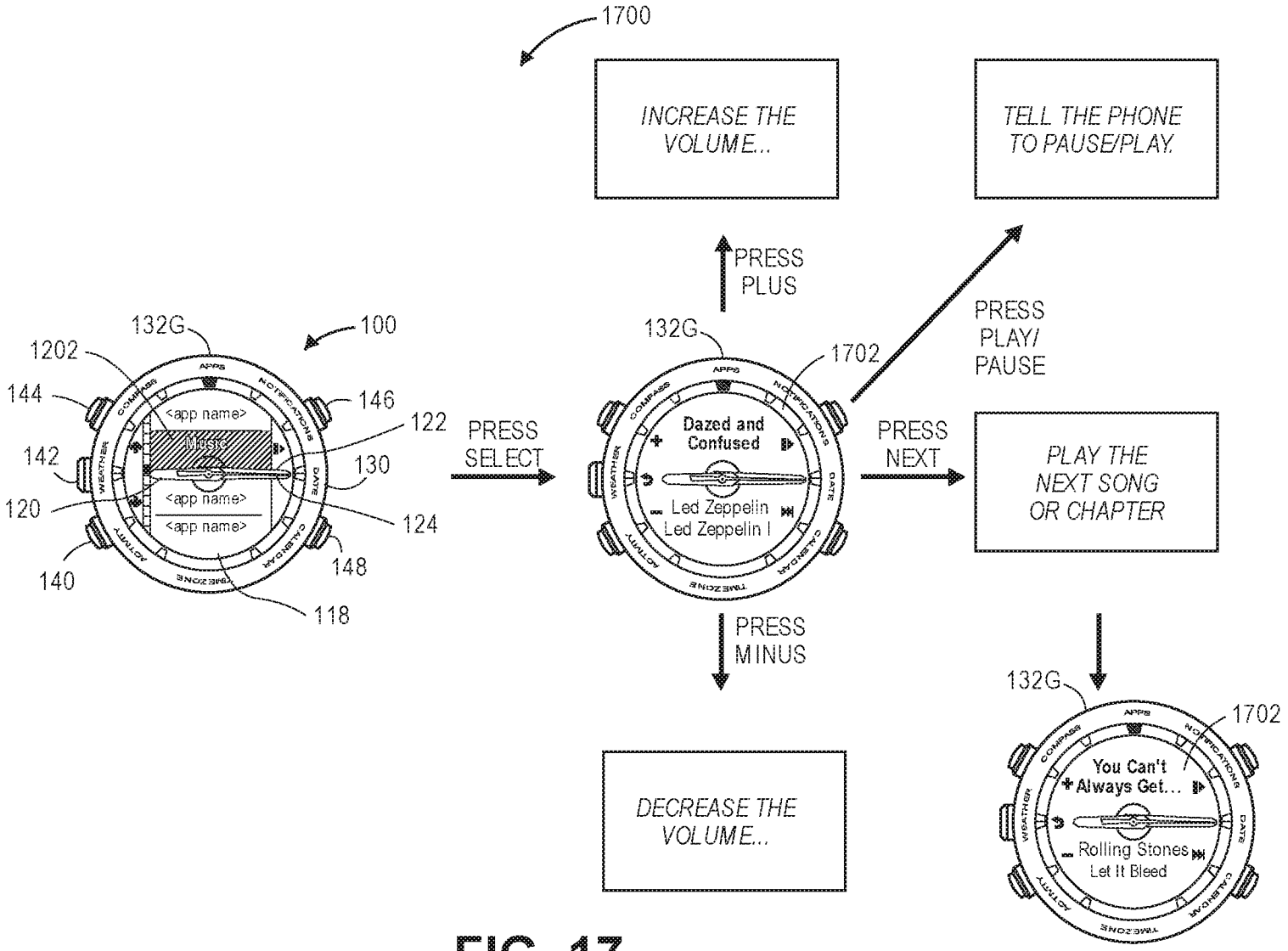
FIG. 17 is a diagrammatic illustration that includes a series of top plan views of the smart watch shown in FIGS. 1A and 1B, further illustrating the smart watch configured to execute a media player application.

FIG. 17 illustrates the smart watch 100 configured to execute a media player (music) application 1700. As shown, the bezel 130 is rotated to the mode selection "APPS" 132G to select the apps mode of operation of the smart watch 100, and a media player application 1700 is selected from the app selection page 1202 as discussed in the description of FIG. 12. The media player application 1700 provides functionality to control the playback of media (e.g., audio (music, podcasts, audiobooks, etc.), video (movies, television, etc.), and the like) by a paired device such as a smart phone or tablet paired to the smart watch 100 via the communication system 158. The media player application 1700 may cause the display device 118 to display a media playback page 1702 that may display information identifying the media. For example, wherein the media comprises music, the information displayed may include the title of the song, the title of the album from which the song is taken, the performer or artist that performs the song, and so forth. Similarly, for an audiobook, the information displayed may include the title of the work, the author of the work, the chapter name and/or number, and so forth. When depressed, the control buttons (e.g., the top left control button 144, the top right control button 146, the bottom left control button 140, or the bottom right control button 148) may be configured to cause the paired device to increase or decrease the volume of the media playback, pause playback of the media, play the next stored media (skip to next song, chapter, etc.), play the previous stored media (replay the previous song, chapter, etc.), and so forth. The display device 18 may display indicia (e.g., "+," "−," pause/play, next, and so forth) to indicated the operation selected. The user may depress a predetermined one of the control buttons (e.g., middle left control button 142 (Back)) to cause the display device 118 to again display the app selection page 1202. As shown, the watch arms 120, 122, 124 may remain rotated to the horizontal fixed configuration 304 to support viewing of the media playback page 1702 by the user of the smart watch unobstructed by the first, second, and third watch arms 120, 122, 124.

Figure 18:
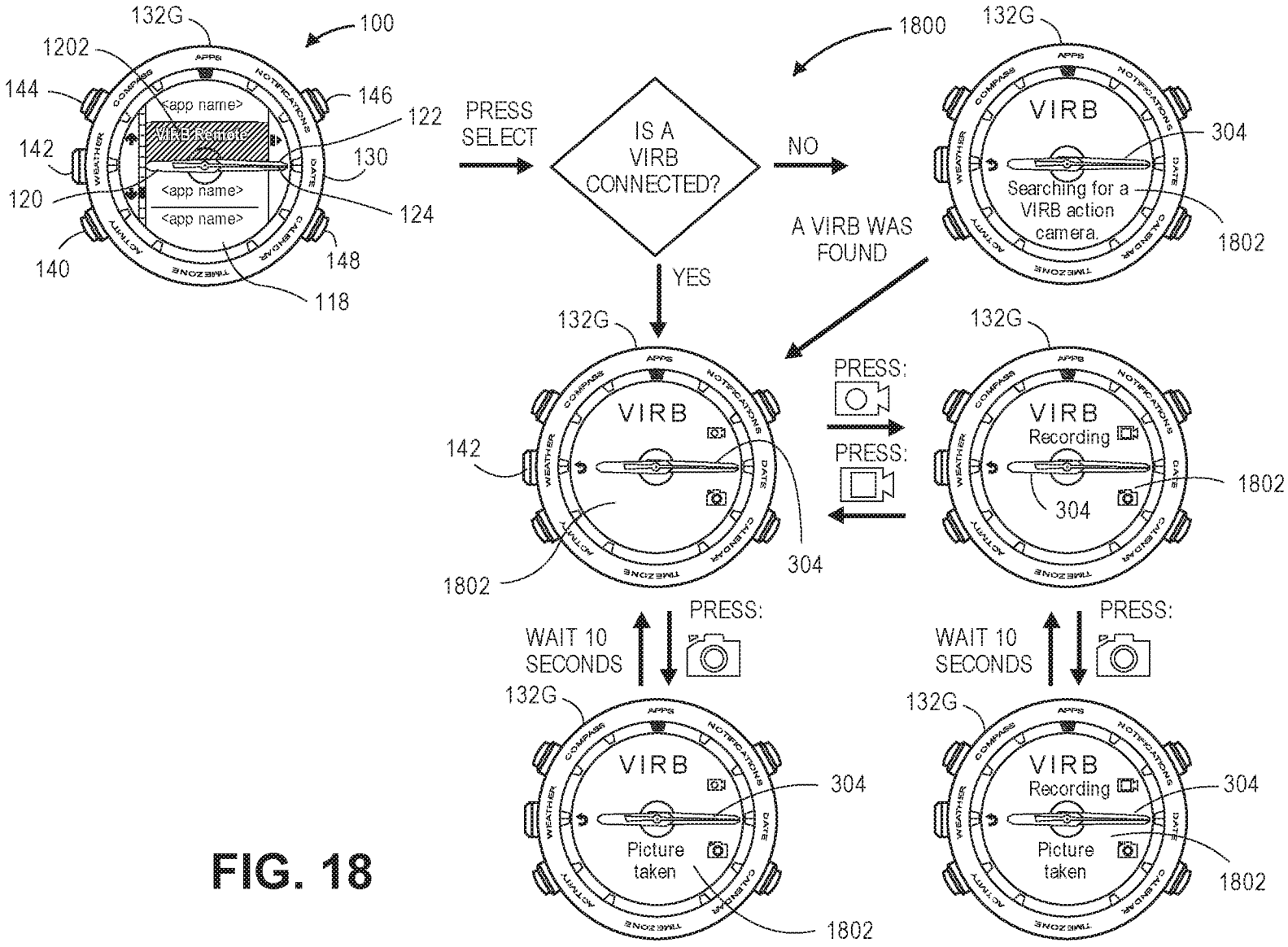
FIG. 18 is a diagrammatic illustration that includes a series of top plan views of the smart watch shown in FIGS. 1A and 1B, further illustrating the smart watch configured to execute a remote control application.

FIG. 18 illustrates the smart watch 100 configured to execute a remote control application 1800. As shown, the bezel 130 is rotated to the mode selection "APPS" 132G to select the apps mode of operation of the smart watch 100, and a remote control application 1800 is selected from the app selection page 1202 as discussed in the description of FIG. 12. The remote control application 1800 provides functionality that allows the user to remotely control the operation of a paired device such as a camera (e.g., a VIRB camera manufactured by Garmin International, Inc., a GoPro camera manufactured by GoPro, Inc., etc.), a monitor, a projector, a computer, a tablet, a television, a video recording device such as a Digital Video Recorder (DVR), and so forth. The remote control application 1800 may cause the display device 118 to display a remote control page 1802 that may display status information used for control of the paired device. The control buttons (e.g., the top left control button 144, the top right control button 146, the bottom left control button 140, or the bottom right control button 148) may be configured to control an operation of the paired device. For example, in the example illustrated, the paired device illustrated comprises a VIRB camera. When depressed, the top left control button 144, the top right control button 146, the bottom left control button 140, or the bottom right control button 148 may cause the VIRB camera to start or stop recording video, to take a photograph, and so forth. The user may depress a predetermined one of the control buttons (e.g., middle left control button 142 (Back)) to cause the display device 118 to again display the app selection page 1202. As shown, the watch arms 120, 122, 124 may remain rotated to the horizontal fixed configuration 304 to support viewing of the remote control page 1802 by the user of the smart watch unobstructed by the first, second, and third watch arms 120, 122, 124.

Figure 19A:
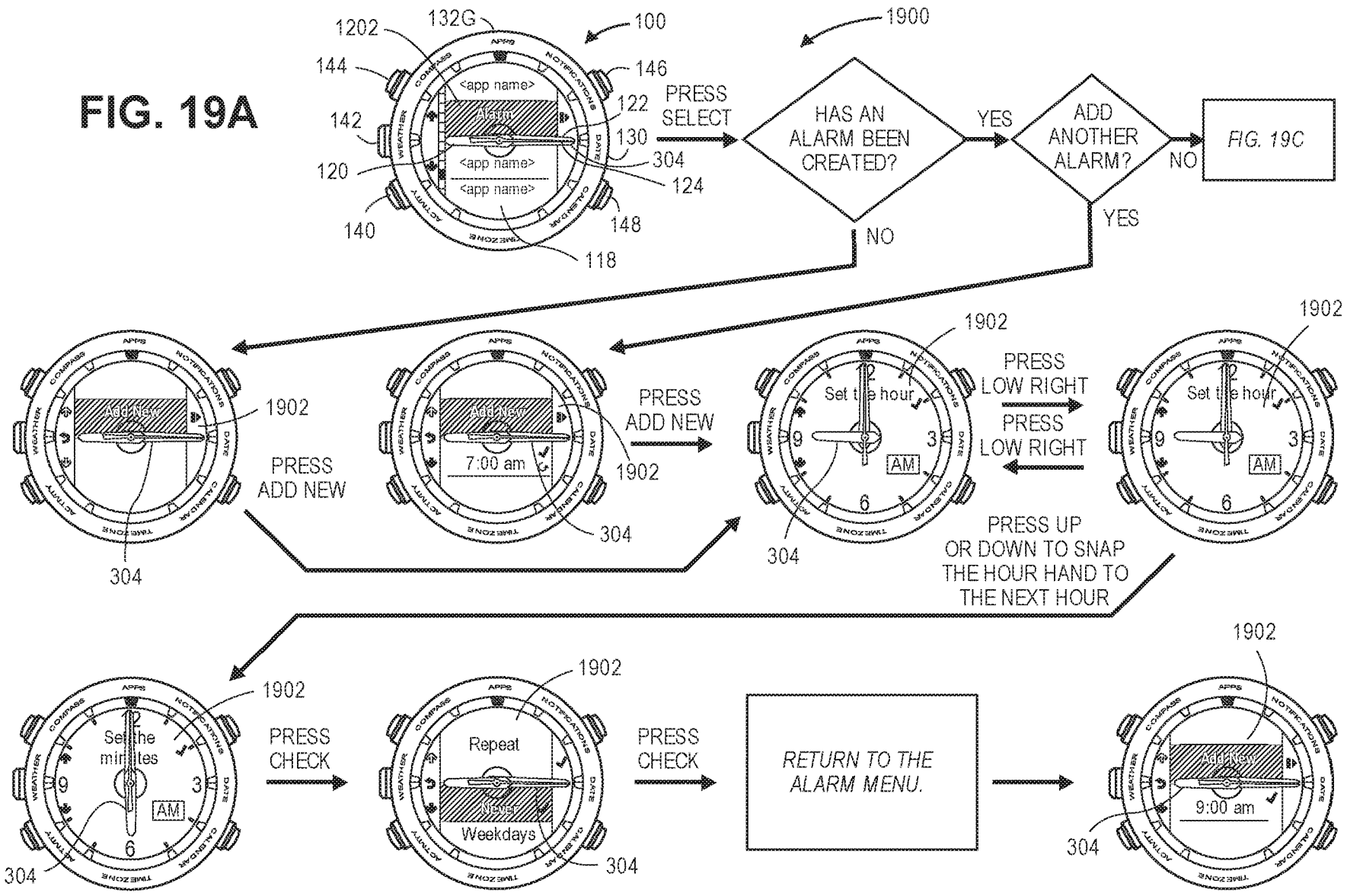
FIGS. 19A, 19B, and 19C are diagrammatic illustrations that include a series of top plan views of the smart watch shown in FIGS. 1A and 1B, further illustrating the smart watch configured to execute an alarm application.
Figure 19B:
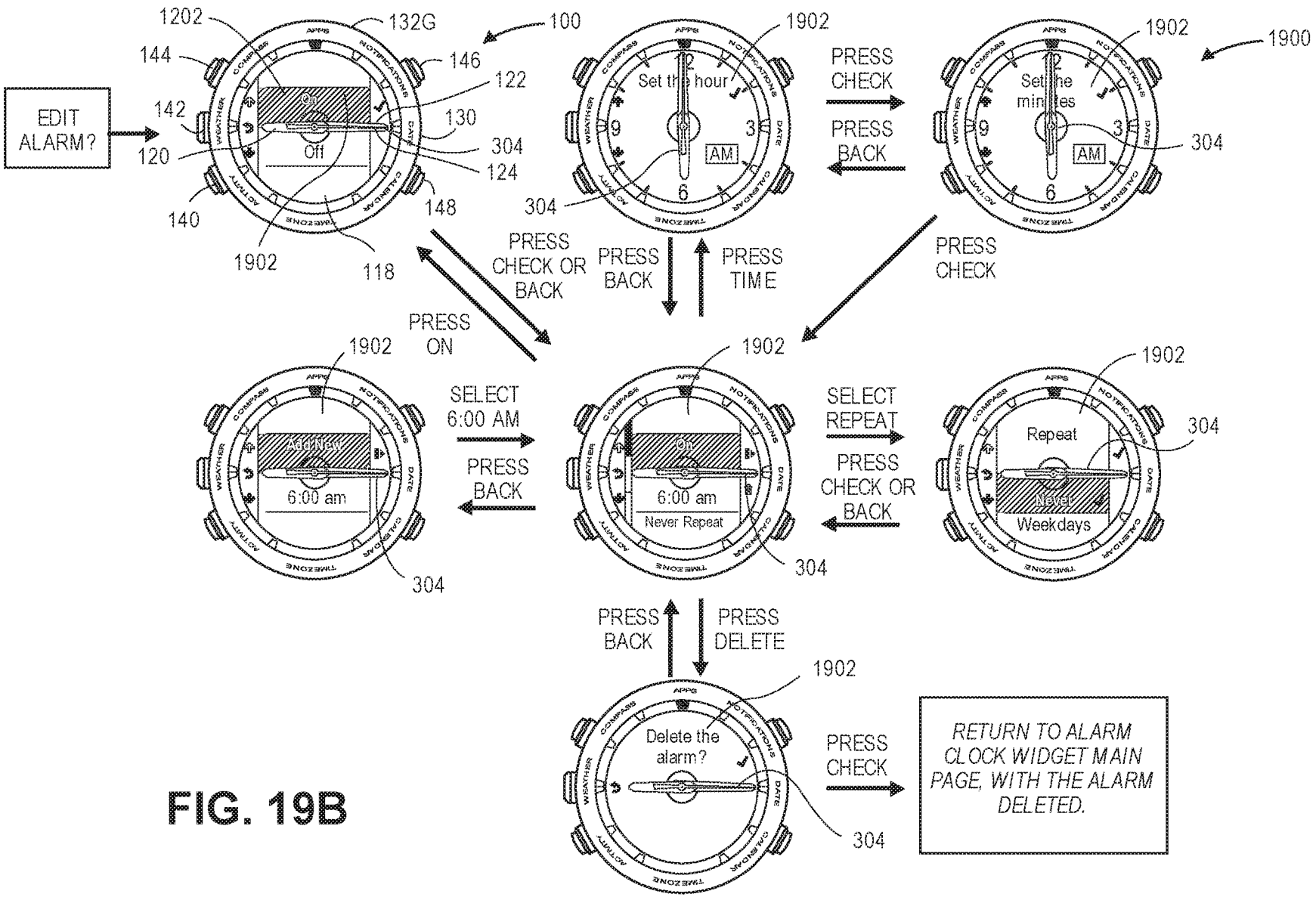
Figure 19C:
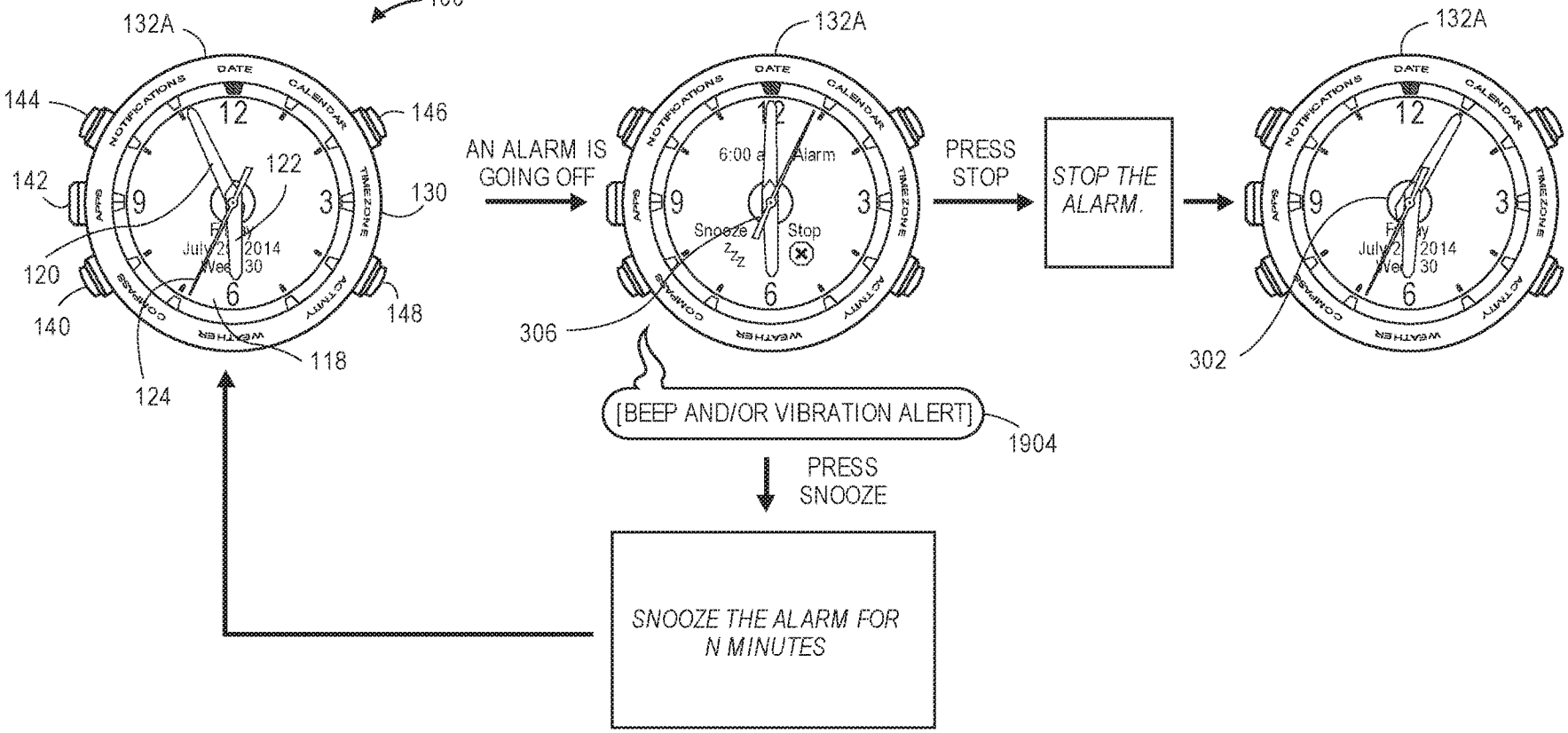

FIGS. 19A, 19B, and 19C illustrate the smart watch 100 configured to execute an alarm application 1900. As shown in FIGS. 19A and 19B, the bezel 130 is rotated to the mode selection "APPS" 132G to select the apps mode of operation of the smart watch 100, and an alarm application 1900 is selected from the app selection page 1202 as discussed in the description of FIG. 12. The alarm application 1900 provides functionality that allows the user to schedule and/or delete one or more alarms. As shown in FIGS. 19A and 19B, the alarm application 1900 may cause the display device 118 to display a set alarm page 1902 that allows the user to set an alarm using the control buttons (e.g., the top left control button 144, the top right control button 146, the bottom left control button 140, or the bottom right control button 148). For example, in the example illustrated, the user may set the hour and minute of the alarm, whether the alarm is before or after noon (e.g., "AM" or "PM"), the day or days of the week of the alarm (e.g., Monday through Friday, Weekdays, Weekends, etc.), whether the alarm is a repeating or a single occurrence alarm, the audible alert (e.g., a "beep") to be used, whether a vibrating alert is to be provided in place of or in addition to the audible alert, combinations thereof, and so forth. The user may depress a predetermined one of the control buttons (e.g., middle left control button 142 (Back)) to cause the display device 118 to again display the app selection page 1202. As shown, the watch arms 120, 122, 124 may remain rotated to the horizontal fixed configuration 304 to support viewing of the set alarm page 1902 by the user of the smart watch unobstructed by the first, second, and third watch arms 120, 122, 124. The alarm application 1900 may cause the first, second, and third watch arms 120, 122, 124 to be rotated between a timekeeping configuration 302 to set the hour and minute of the alarm, and a horizontal fixed configuration 304 to support unobstructed viewing of the set alarm page 1902 by the user as the alarm is set. The user may depress a predetermined one of the control buttons (e.g., middle left control button 142) to cause the display device 118 to again display the app selection page 1202.

When the set alarm time is reached, as shown in FIG. 19C, the alarm application 1900 initiates the alarm and causes an audible alert and/or a vibration alert 1904 to be provided to the user of the smart watch 100. In embodiments, the alarm application 1900 may cause the alarm to be initiated in any mode of operation of the smart watch 100. As illustrated, the alarm application 1900 may further include a snooze function that may be activated when the alarm is initiated to stop the alarm ringtone or beep and/or vibration alert 1904 for a predetermined period of time. The user may initiate the snooze function by depressing a control button 140, 142, 144, 146, 148 (e.g., the lower left control button 140 ("Snooze")). Similarly, the user may turn off the alarm by depressing a control button 140, 142, 144, 146, 148 (e.g., lower right control button 148 ("Stop")

Figure 20A:
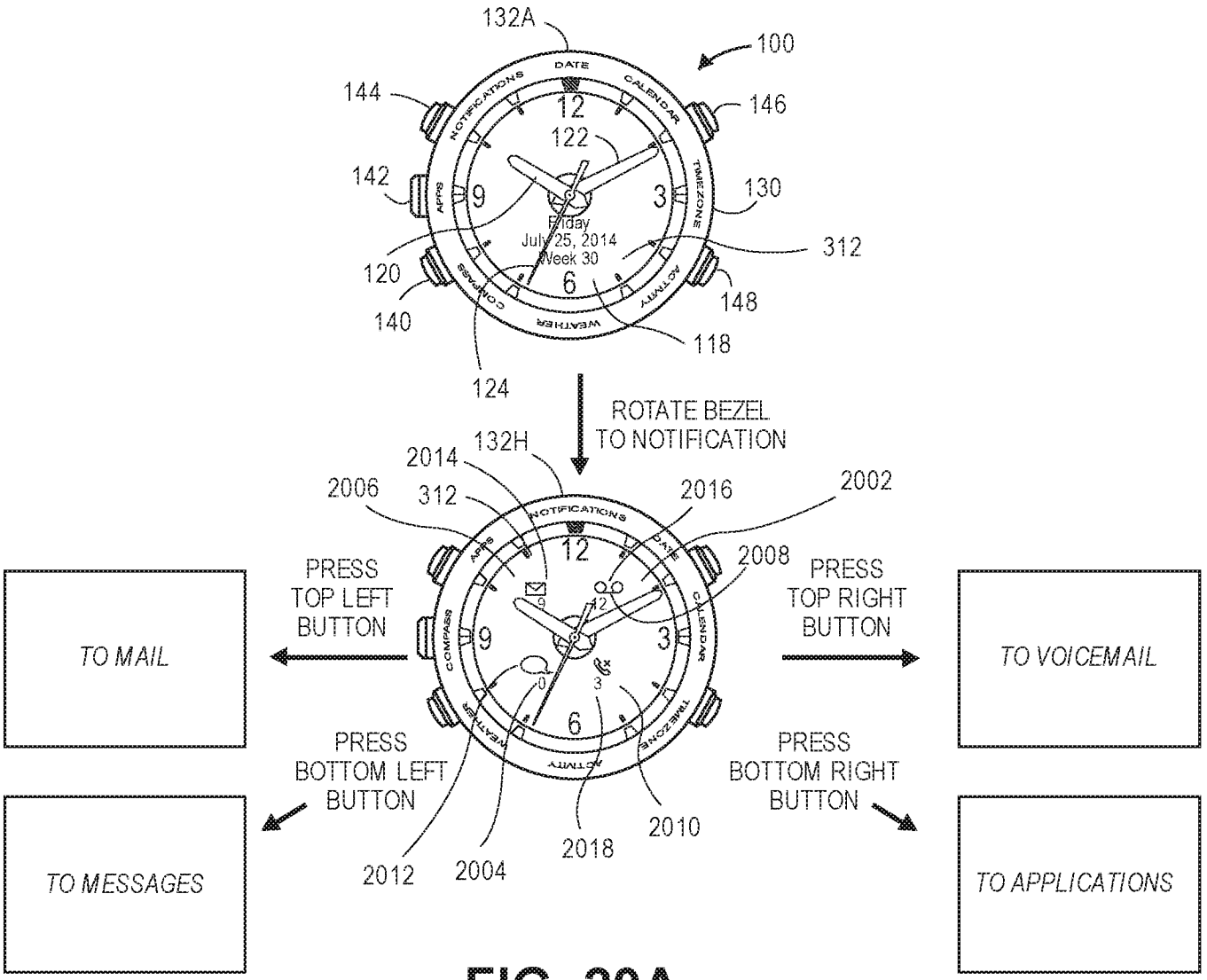
FIGS. 20A and 20B is a diagrammatic illustration that includes a series of top plan views of the smart watch shown in FIGS. 1A and 1B, further illustrating the smart watch configured to display notifications to the user of the smart watch.
Figure 20B:
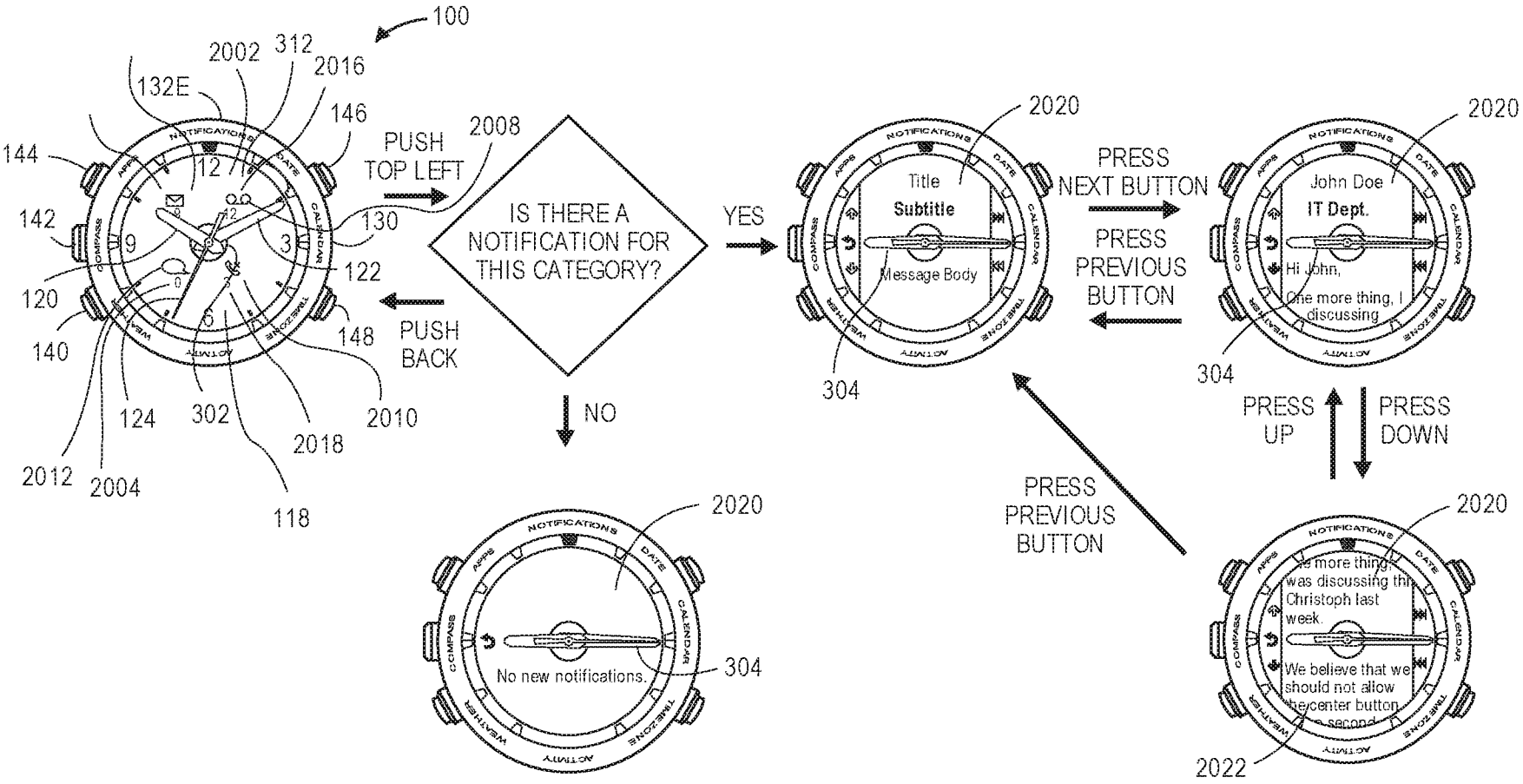

FIGS. 20A and 20B illustrate the smart watch 100 configured to display notifications to the user. As shown, the bezel 130 is rotated to the mode selection "NOTIFICATIONS" 132H to select the notifications mode of operation of the smart watch 100. In the notifications mode of operation, the smart watch 100 may be configured to furnish notifications received through a paired device such as a paired smart phone or tablet that is paired with the smart watch 100 via the communication system 158. As shown in FIG. 20A, the display device 118 may be configured to display a notifications menu 2002 within the watch dial 312 while the analog watch arms 120, 122, 124 are in the timekeeping configuration. In the embodiment illustrated, the notifications menu 2002 facilitates access by the user to notifications provided by the paired device. Example notifications may include notifications that the paired device has received an email message, notifications that the paired device has received a text (e.g., SMS or MMS) message, notifications that the paired device has received a voicemail message, notifications generated by applications 162 executed by the smart watch 100 and/or the paired device, notifications related to social media, combinations thereof, and so forth. Additional information associated with the notifications may be stored on a remote server or device and accessed using the communication system 158. In the embodiment shown, the notifications menu 2002 may be divided into four quadrants 2004, 2006, 2008, 2010 each having a selectable menu item 2012, 2014, 2016, 2018, which correspond to a particular kind or kinds of messages for which notifications are furnished. As shown, the selectable menu items 2012, 2014, 2016, 2018 may be identified by indicia such as an icon (e.g., a message bubble icon identifying a text message menu item 2012, an envelope icon identifying an email menu item 2014, a tape icon identifying a voicemail menu item 2016, a telephone icon representing a telephone menu item 2018, and so forth) The selectable menu items 2012, 2014, 2016, 2018 may be associated with a respective one of the control buttons (e.g., the bottom left control button 140, the top left control button 144, the top right control button 146, and the bottom right control button 148). In instances where the paired device has received one or more unread messages for which a notification is provided, the associated icon may further include an indication of the number of unread messages received (e.g., a bubble containing a number representing the number of that type of message received).

As shown in FIG. 20B, the user may depress the control button 140, 144, 146, 148 that is associated with the quadrant 2004, 2006, 2008, 2010 having the selectable menu item 2012, 2014, 2016, 2018 associated with the kind of message for which a notification is provided to access the message(s) via the display device 118. Selection of a menu item 2012, 2014, 2016, 2018 causes the display device 118 to display a message viewing page 2020 which displays the message 2022 associated with the notification. The first, second, and third watch arms 120, 122, 124 are rotated to the horizontal fixed configuration 304 to allow the user to view the message unobstructed by the watch arms 120, 122, 124. When the message viewing page 2020 is displayed, the user may depress the bottom left control button 140 and/or the top left control button 144 to scroll through the message 2022. Similarly, the user may depress the top right control button 146 (Up) and/or the bottom right control button 148 (Down) to scroll though the messages received to display another message. The user may depress a predetermined one of the control buttons (e.g., middle left control button 142) to cause the display device 118 to again display the notification menu 2002.

Figure 21:
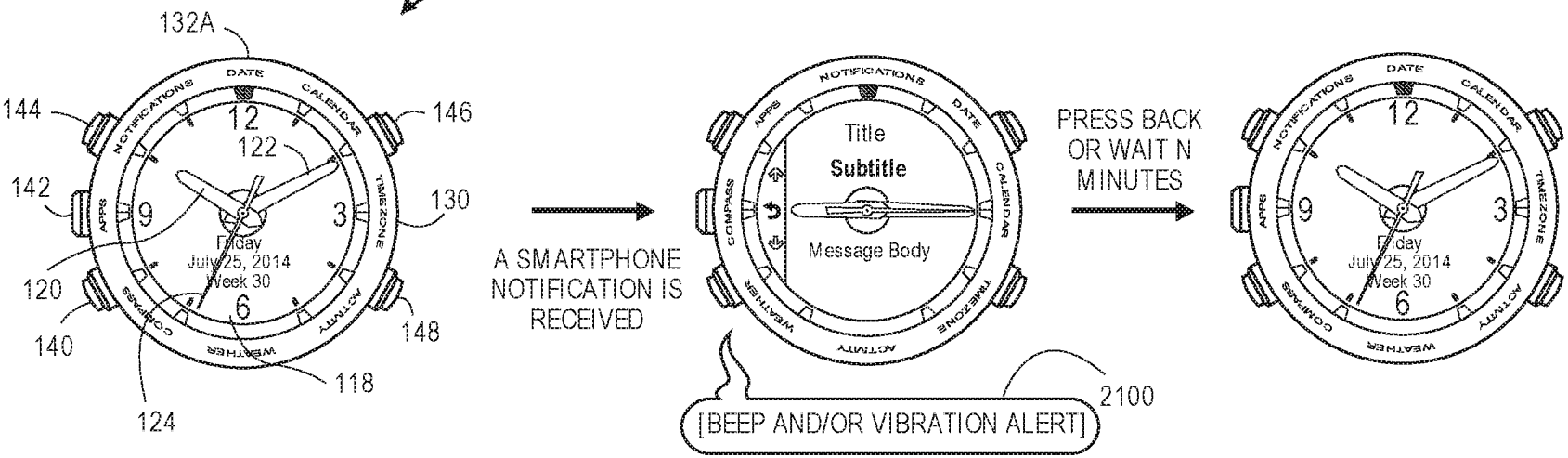
FIG. 21 is a diagrammatic illustration that includes a series of top plan views of the smart watch shown in FIGS. 1A and 1B, further illustrating the smart watch configured to convey notifications to the user.

As shown in FIG. 21, the smart watch 100 may furnish an alert 2100 when a new notification is received. For example, an audible alert and/or a vibration alert 2100 may be provided to the user of the smart watch 100 when a new notification is available. In embodiments, the alert 2100 may be initiated in any mode of operation of the smart watch 100, or only when the smart watch 100 is in the notification mode of operation.

Conclusion

Although the smart watch has been described with reference to example embodiments illustrated in the attached drawing figures, it is noted that equivalents may be employed and substitutions made herein without departing from the scope of the invention as recited in the claims. Further, the smart watch and its components as illustrated and described herein are merely examples of a device and components that may be used to implement subject matter the present disclosure, and may be replaced with other devices and components without departing from the scope of the present invention.

What is claimed is:

1. A smart watch, comprising:

a case having a face;

a display device disposed in substantially all of the face of the case, the display device configured to present a user interface;

a communication element configured to receive data from a paired device;

a memory configured to store the received data;

an analog first watch arm and an analog second watch arm disposed over the display, the second watch arm coaxial with the first watch arm;

a watch arm drive disposed within the case, the watch arm drive configured to independently rotate the first watch arm and the second watch arm; and a processor coupled with the display device, the memory and the watch arm drive, the processor configured to:

cause the user interface to present a watch dial and control the watch arm drive to rotate the first and second watch arms to indicate a time of day in a first mode of operation, and cause the user interface to present a second dial and control the watch arm drive to rotate the first and second watch arms to form a pointer in a second mode of operation, the pointer configured to indicate on the second dial a reading corresponding to the received data;

wherein only the watch dial and the second dial are presented on the user interface in the first mode of operation and the second mode of operation, respectively.

2. The smart watch as recited in claim 1, wherein the watch arm drive can rotate each of the first watch arm and the second watch arm in a clockwise direction or a counterclockwise direction.

3. The smart watch as recited in claim 1, further comprising a first shaft coupling the first watch arm with the watch arm drive and a second shaft coupling the second watch arm with the watch arm drive.

4. The smart watch as recited in claim 1, wherein the second mode of operation is associated with weather and the second dial is a thermometer dial including a temperature range.

5. The smart watch as recited in claim 1, wherein the second mode of operation is associated with weather and the second dial is a barometer dial including a barometric pressure range.

6. The smart watch as recited in claim 1, wherein the second mode of operation is associated with weather and the second dial is a humidity dial including a humidity percentage range.

7. The smart watch as recited in claim 1, wherein the second mode of operation is associated with a download operation of data from the paired device and the second dial is a download status dial.

8. The smart watch as recited in claim 1, wherein the second mode of operation is associated with golf and the second dial is a distance dial including yardage.

9. The smart watch as recited in claim 1, wherein the second mode of operation is associated with sleep tracking and the second dial is a sleep timer dial including count-up timer indicia.

10. The smart watch as recited in claim 1, wherein the second mode of operation is a stopwatch and the second dial is a timer dial including count-up timer indicia.

11. The smart watch as recited in claim 1, wherein the second dial is a compass rose and the first and second watch arms form a compass needle, the compass needle configured to indicate a current direction on the compass rose.

12. The smart watch as recited in claim 1, further comprising an analog third watch arm disposed over the display device, the third watch arm coaxial with the first and second watch arms, the first, second and third watch arms configured to rotate independently.

13. A smart watch, comprising:

a case having a face;

a display device disposed in substantially all of the face of the case, the display device configured to present a user interface;

a communication element configured to receive data from a paired device;

a memory configured to store the received data;

an analog first watch arm and an analog second watch arm disposed over the display, the second watch arm coaxial with the first watch arm;

a watch arm drive disposed within the case, the watch arm drive configured to independently rotate the first watch arm and the second watch arm;

a first shaft coupling the first watch arm with the watch arm drive;

a second shaft coupling the second watch arm with the watch arm drive; and a processor coupled with the display device, the memory and the watch arm drive, the processor configured to:

cause the user interface to present a watch dial and control the watch arm drive to rotate the first and second shafts to cause the first and second watch arms to indicate a time of day in a first mode of operation, and cause the user interface to present a second dial and control the watch arm drive to rotate the first and second shafts to form a pointer by the first and second watch arms in a second mode of operation, the pointer configured to indicate on the second dial a reading corresponding to the received data;

wherein only the watch dial and the second dial are presented on the user interface in the first mode of operation and the second mode of operation, respectively.

14. The smart watch as recited in claim 13, wherein the watch arm drive can rotate each of the first and second shafts in a clockwise direction or a counterclockwise direction.

15. The smart watch as recited in claim 13, wherein the second mode of operation is associated with weather and the second dial is a thermometer dial including a temperature range.

16. The smart watch as recited in claim 13, wherein the second mode of operation is associated with a download operation of data from the paired device and the second dial is a download status dial.

17. The smart watch as recited in claim 13, wherein the second mode of operation is a stopwatch and the second dial is a timer dial, the timer dial including count-up timer indicia.

18. The smart watch as recited in claim 13, wherein the second dial is a compass rose and the first and second watch arms form a compass needle, the compass needle configured to indicate a current direction on the compass rose.

19. A smart watch, comprising:

a case having a face;

a display device disposed in substantially all of the face of the case, the display device configured to present a user interface;

a communication element configured to receive data from a paired device;

a memory configured to store the received data;

an analog first watch arm and an analog second watch arm disposed over the display, the second watch arm coaxial with the first watch arm;

a watch arm drive disposed within the case, the watch arm drive configured to independently rotate the first watch arm and the second watch arm in a clockwise direction or a counterclockwise direction; and a processor coupled with the display device, the memory and the watch arm drive, the processor configured to:

cause the user interface to present a watch dial and control the watch arm drive to rotate the first and second watch arms to indicate a time of day in a first mode of operation, and cause the user interface to present a second dial and control the watch arm drive to rotate the first and second watch arms to form a pointer in a second mode of operation, the pointer configured to indicate on the second dial a reading corresponding to the received data;

wherein only the watch dial and the second dial are presented on the user interface in the first mode of operation and the second mode of operation, respectively.

20. The smart watch as recited in claim 19, further comprising a first shaft coupling the first watch arm with the watch arm drive and a second shaft coupling the second watch arm with the watch arm drive.

* * * * *